US011702894B2

(12) United States Patent
Holck

(10) Patent No.: US 11,702,894 B2
(45) **Date of Patent: *Jul. 18, 2023**

(54) ROBOTIC APPARATUS FOR PERFORMING DRILL FLOOR OPERATIONS

(71) Applicant: NOBLE DRILLING A/S, Kongens Lyngby (DK)

(72) Inventor: Jesper Holck, Hellerup (DK)

(73) Assignee: NOBLE DRILLING A/S, Kgs. Lyngby (DK)

( * ) Notice: Subject to any disclaimer, the term of this patent is extended or adjusted under 35 U.S.C. 154(b) by 0 days.

This patent is subject to a terminal disclaimer.

(21) Appl. No.: 17/539,329

(22) Filed: Dec. 1, 2021

(65) Prior Publication Data

US 2022/0120146 A1 Apr. 21, 2022

Related U.S. Application Data

(63) Continuation of application No. 16/979,311, filed as application No. PCT/DK2019/050085 on Mar. 11, 2019, now Pat. No. 11,293,236.

(30) Foreign Application Priority Data

Mar. 11, 2018 (DK) ..... PA 2018 00111

(51) Int. Cl.
*E21B 19/16* (2006.01)
*E21B 19/10* (2006.01)

(52) U.S. Cl.
CPC ..... *E21B 19/161* (2013.01); *E21B 19/10* (2013.01)

(58) Field of Classification Search
CPC ..... E21B 19/16–168
See application file for complete search history.

(56) References Cited

U.S. PATENT DOCUMENTS

| | | | | |
|---|---|---|---|---|
| 4,765,401 | A | 8/1988 | Boyadjieff | |
| 11,293,236 | B2 * | 4/2022 | Holck | E21B 19/15 |
| 2010/0230115 | A1 | 9/2010 | Belik | |
| 2010/0303586 | A1 | 12/2010 | Hankins et al. | |
| 2011/0079434 | A1 | 4/2011 | Belik et al. | |
| 2016/0160582 | A1 | 6/2016 | Huseman et al. | |

(Continued)

FOREIGN PATENT DOCUMENTS

| | | | |
|---|---|---|---|
| CN | 106593325 | A | 4/2017 |
| EP | 0171368 | A1 | 2/1986 |

(Continued)

OTHER PUBLICATIONS

International Search Report (PCT/ISA/210) dated Jun. 21, 2019, by the European Patent Office as the International Searching Authority for International Application No. PCT/DK2019/050085.

(Continued)

*Primary Examiner* — Kristyn A Hall
(74) *Attorney, Agent, or Firm* — Buchanan Ingersoll & Rooney PC

(57) ABSTRACT

A robotic apparatus (1) for performing drill floor operations comprises a support arrangement (2) and at least one manipulator arm (6). The at least one manipulator arm (6) is configured to carry an end effector (11) configured to manipulate one or more of tubing, tools and/or equipment on a drill floor (d) or pipe deck of an oil and gas rig in order to perform a given drill floor operation.

18 Claims, 20 Drawing Sheets

(56) References Cited

U.S. PATENT DOCUMENTS

| | | | |
|---|---|---|---|
| 2016/0201408 | A1 | 7/2016 | Little et al. |
| 2021/0002995 | A1 | 1/2021 | Botnan et al. |
| 2021/0054701 | A1 | 2/2021 | Holck |

FOREIGN PATENT DOCUMENTS

| | | | |
|---|---|---|---|
| WO | 2005059299 | A1 | 6/2005 |
| WO | 2014026038 | A1 | 2/2014 |
| WO | 2014182160 | A2 | 11/2014 |
| WO | 2015021558 | A1 | 2/2015 |
| WO | 2016106327 | A1 | 6/2016 |
| WO | 2016199103 | A1 | 12/2016 |
| WO | 2017087349 | A1 | 5/2017 |

OTHER PUBLICATIONS

Written Opinion (PCT/ISA/237) dated Jun. 21, 2019, by the European Patent Office as the International Searching Authority for International Application No. PCT/DK2019/050085.

* cited by examiner

ROBOTIC APPARATUS FOR PERFORMING DRILL FLOOR OPERATIONS

CROSS-REFERENCE TO RELATED APPLICATIONS

The present application claims priority of U.S. patent application Ser. No. 16/979,311, filed on Sep. 9, 2020, which is a national stage of PCT/DK2019/050085, filed on Mar. 11, 2019, which claims priority of Danish Patent Application No. PA 2018 00111, filed on Mar. 11, 2018, the entire disclosures of which are incorporated herein by reference.

FIELD

This relates to a robotic apparatus for performing drill floor operations.

BACKGROUND

In the oil and gas industry, the construction and operation of a given well involves numerous operations, many of which are carried out manually at the drill floor.

These manual operations may, for example, include the handling and installation of tubing sections, such as drill pipe, casing, pup-joints, crossovers and/or lifting subs, and require the accurate positioning of the tubing sections at the well centre before the tubing sections are engaged ("stabbed in").

The handling and installation operations may involve the use of safety clamps ("dog collars") and manual slips used to handle drill collars and/or bottom hole assemblies (BHA), and/or the removal of casing thread protectors from the tubing sections while on the drill floor.

There are a number of challenges and risks associated with conventional operations. For example, a given operation may be carried out on a number of occasions per day and may require 2 to 3 operators to complete, with each operation introducing the possibility of manual error.

The tubing sections, tools and equipment used to carry out drill floor operations occupy a significant footprint, such that space on the drill floor is typically very limited.

Also, due to their size and mass the handling of the tubing sections, tools and equipment represent a safety risk to personnel operating on the drill floor.

The drill floor itself is typically exposed to the surrounding environment, such that the ability to perform manual operations may be limited by adverse weather conditions and/or vessel motions.

Moreover, as the drill floor provides access to the well, there is the risk that objects can be accidentally dropped into the well.

SUMMARY

According to a first aspect, there is provided a robotic apparatus for performing drill floor operations, comprising:

a support arrangement;

at least one manipulator arm configured for coupling to the support arrangement, the at least one manipulator arm configured to carry an end effector configured to manipulate one or more of tubing, tools and/or equipment on a drill floor or pipe deck of an oil and gas platform in order to perform a given drill floor operation.

In use, the apparatus is configured for the manipulation of tubing, tools and/or equipment on a drill floor or pipe deck of an oil and gas platform, while enhancing the safety and efficiency of operations.

The apparatus may be modular.

For example, the at least one manipulator arm may be detachably coupled to the support arrangement.

Beneficially, the provision of a modular apparatus permits a single apparatus to be adapted to perform a variety of drill floor operations, obviating the requirement for bespoke tools for each operation and reducing the space occupied on the drill floor. By its modular architecture, the apparatus may be configured with appropriate manipulators and sensors to undertake a number of different work tasks on the drill floor area, including for example but not exclusively: the manipulation and make up of drill pipe sections; the manipulation and make up of crossovers and subs; the manipulation and make up of casing; thread protector removal; lift sub installation; setting of manual slips and safety clamps; tugger line guiding; the installation (e.g. clamping) and removal of BOP mux control line cables for the drilling or completion riser during deployment or retrieval, while being fixed or temporarily mounted in suitable locations in the moonpool area; operation as mobile maintenance robots configured for man-machine collaboration, e.g. for accurate and delicate manipulation of heavy spare parts and tools inside machinery spaces or on the drill floor; operation as mobile warehouse/shelving robots for autonomous operations, e.g. for identification, recording, stacking and retrieval of spare parts.

The support arrangement may be configured to move relative to the drill floor.

In use, the apparatus may be configured to move between a storage position and a deployed position. The deployed position may, for example, be located adjacent to the well centre. The apparatus may be configured to move between the storage position and the deployed position via one or more intermediate location, such as a tool rack or the like disposed on the drill floor.

The support arrangement may take a number of different forms.

The support arrangement may for example comprise or take the form of an undercarriage.

The undercarriage may be configured to travel on a track or defined pathway provided in or on the drill floor.

For example, the undercarriage may comprise a catwalk machine, skid-base or similar system travelling towards the well/work centre on tracks/skids.

Alternatively, the undercarriage may take the form of a continuous track system or other arrangement which does not require a defined track or pathway.

Beneficially, the provision of a continuous track system (also known as a caterpillar track system) means that the apparatus is not limited to a particular pathway, which may otherwise limit freedom of movement of the apparatus and the type of operations that it can carry out. Beneficially, the provision of a continuous track system also means that the apparatus can be moved so as to avoid obstructing other equipment on the drill floor, or other robotic apparatus.

In particular embodiments, the apparatus may be configured for multi-directional movement.

The apparatus may comprise a multi-directional caterpillar drive.

The apparatus may comprise one or more omni-directional drive unit.

Beneficially, the provision of a multi-directional caterpillar drive permits movement of the apparatus in any required direction, including forwards and/or backwards movements, lateral or sideways movements, diagonal movements and/or rotational movements.

The omni-directional drive unit may, for example, comprise or take the form of one or more omni-directional roller.

The omni-directional drive unit may be disposed on the undercarriage.

Alternatively, the support arrangement may comprise, or take the form of, a base. The base may be configured to fix the apparatus at a given location on the drill floor.

The base may directly fix the apparatus to the drill floor.

Alternatively, the base may provide a raised foundation/structure e.g. on a windwall or on a derrick member.

The apparatus may comprise, or where the apparatus is modular may be configured to comprise, a single manipulator arm.

In some instances, the operator may require the apparatus to perform a single function. The apparatus permits this function to be carried out without introducing unnecessary equipment onto the drill floor.

Alternatively, the apparatus may comprise, or where the apparatus is modular may be configured to comprise, a plurality of manipulator arms.

In particular, but not exclusively, the apparatus may comprise two manipulator arms.

Beneficially, the provision of an apparatus having two manipulator arms permits multiple operations to be carried out on the drill floor. Moreover, a first of the manipulator arms may be used to provide a reference location for the second manipulator arm, reducing the requirement for complex positioning systems.

The manipulator arm may comprise a body for coupling the manipulator arm to the support arrangement.

The manipulator arm may comprise a first linkage element.

The manipulator arm may comprise a second linkage element.

The first linkage element may be coupled to the body by an actuator.

The actuator may provide a first degree of freedom of the manipulator arm.

The actuator may take the form of a rotary actuator.

The second linkage element may be coupled to the first linkage element by an actuator.

The actuator may provide a second degree of freedom of the manipulator arm. The actuator takes the form of a rotary actuator.

The apparatus may comprise the end effector.

The end effector may be connected to a distal end of the manipulator arm.

The end effector may take a number of different forms.

The end effector may take the form of a clamping tool.

In use, the apparatus may beneficially be utilised to replace the manual operation of safety clamps and slips, e.g. when handling drill collars and bottom hole assemblies through the rotary.

The clamping tool may comprise a first jaw portion.

The clamping tool may comprise a second jaw portion.

The first jaw portion and the second jaw portion may be pivotably coupled together. The first jaw portion and the second jaw portion may be pivotably coupled together via a joint.

In use, the clamping tool may be reconfigurable between an open configuration which facilitates location of the damping tool about a tubing section and a closed configuration permitting the clamping tool to be secured about the tubing section.

The clamping tool may comprise or may be coupled to slips for gripping the tubing section.

A portion of the clamping tool may be tapered. Beneficially, providing a tapered portion may provide a guide for location of another tubing section onto the tubing section.

In use, the support arrangement may be moveable across the drill floor from a first, storage, position to a second, deployed, position. In the second, deployed, position the manipulator arm and clamping tool may be operable to engage and hold down the slips until there is sufficient weight on the tubing section to force the tubing section down into the slips.

The end effector may take the form of a tubing handling tool.

In use, the tubing handling tool may beneficially replace the manual handling and installation of drill pipe, casing, pup joints, crossovers or the use of lifting-subs where these are being installed inside the tubulars while on the drill floor.

The tubing handling tool may comprise a first jaw portion.

The tubing handling tool may comprise a second jaw portion.

The first jaw portion and the second jaw portion may be pivotably coupled together.

The first jaw portion and the second jaw portion may be pivotably coupled together via a hinge.

In use, the manipulator arm and the tubing handling tool may be operable to engage and manipulate a tubing section. In order to engage and manipulate the tubing section the tubing handling tool may be reconfigurable between an open configuration and a closed configuration permitting the tubing handling tool to securely grasp tubing section.

The end effector may comprise a thread protector removal tool.

The thread protector removal tool may comprise an impact wrench, or the like.

The end effector may additionally or alternatively comprise one or more of a casing stabbing guide, a safety clamp manipulator, a spinner/impact wrench, a wire gripper/guide, and a handle grabber.

Beneficially, the apparatus provides the facility for alternative interchangeable robotic tools and manipulator heads etc. used for the various work tasks as defined for the robot (e.g. for gripping, lifting, guiding, stabbing, spinning/torqueing, rotating, turning etc.)

The apparatus may be configured to position itself relative to the well centre.

The apparatus may, for example, be configured to engage and/or lock onto the stick up. Beneficially, the ability to engage and/or lock onto the stick up provides the apparatus with a fixed point of reference relative to the well centre.

In particular embodiments, the end effector (or in embodiments comprising a plurality of manipulator arms the end effector of one of the manipulator arms) may be configured to engage and/or lock onto the stick up.

Alternatively, or additionally, the apparatus may comprise or may be operatively associated with a tool or mechanism for engaging and/or locking onto the stick up. The tool or mechanism may comprise or take the form of a centring and/or grabbing arrangement.

As described above, the at least one manipulator arm may be configured to manipulate one or more of tubing, tools and/or equipment on a drill floor or pipe deck of an oil and gas platform in order to perform a given drill floor operation.

The apparatus may comprise or may be coupled to a rack for storing the tools, tubing and/or equipment to be manipulated.

The tool rack may be an onboard rack that is disposed on or in a body of the apparatus.

Beneficially, the provision of an onboard rack reduces non-operational time which would otherwise be spent travelling to a remote tool, tubing or equipment store, increasing the efficiency of the given work task.

The apparatus may comprise, or may be coupled to, a power system for supplying power to the apparatus.

The apparatus may comprise an electrical power system.

The apparatus may comprise a hydraulic power system.

The power system may comprise, may be coupled or operatively associated with one or more power conduits.

The one or more power conduits may comprise at least one of a hydraulic power conduit and an electrical power conduit.

The power system may comprise a cable power system e.g. a dragchain system or the like.

The one or more power conduits may comprise a hose, such as a hydraulic hose or the like.

At least one of the power conduits may be stored on, conveyed from/onto a reel.

The power system may comprise a connector arrangement.

The connector arrangement may, for example, comprise or the take the form of quick connectors. In use, quick-connectors may initially be hooked-up, either autonomously or manually, near the work location during pre-work inspection of the apparatus.

The apparatus may comprise a single or a hybrid external power supply wherein electrical and/or hydraulic power may be provided from an external source through cable- or hose reels and is conveniently connected or disconnected to the apparatus either manually or automatically.

The apparatus may comprise one or more of an electrical cable or a hydraulic hose manually and/or automatically connectable to the external power supply and/or the apparatus.

The apparatus may be powered by an onboard power supply, e.g. a battery.

Where the apparatus is powered by an onboard power supply, e.g. a battery, an electrical charging/docking station may be provided, e.g. in the drill floor area.

The charging/docking station may be configured to automatically charge the apparatus on location of the apparatus at the charging/docking station. Beneficially, this mitigates the risk to personnel of having to plug-in and charge the apparatus between work tasks.

In particular embodiments, the power supply may comprise or take the form of a hybrid power supply. For example, the apparatus may be configured to utilise the onboard power supply, e.g. battery, to manoeuvre from the charging/docking station to one or more predefined work locations around the well centre on the drill floor, the apparatus configured to use electrical power and/or hydraulic power for a given work task.

The apparatus may comprise a sensor arrangement.

The sensor arrangement may comprise a visual sensor arrangement.

The visual sensor arrangement may, e.g. comprise or take the form of a camera system or the like.

The visual sensor arrangement may comprise or may be operatively associated with a machine vision system, or other suitable smart sensor system(s).

The machine vision system may implement, or may be operatively associated with, a machine learning system. Beneficially, the machine learning system facilitates reliable sensing and detection and as necessary controls apparatus motions to perform given tasks.

The sensor arrangement may comprise one or more sensors configured to facilitate guidance of the apparatus and/or components of the apparatus such the manipulator arms.

The sensor arrangement may comprise one or more position sensors.

The sensor arrangement may comprise one or more orientation sensors.

The sensor arrangement may comprise one or more alignment sensors.

Beneficially, the provision of a sensor arrangement comprising one or more sensors configured to facilitate guidance of the apparatus and/or components of the apparatus such the manipulator arms permits, amongst other things, correct stabbing procedures.

The sensor arrangement may comprise one or more sensors configured to facilitate inspection of tools, equipment or the apparatus or its components.

This may involve a visual sensor arrangement such as the visual sensor arrangement described above, or other suitable sensor arrangement.

Beneficially, the provision of a sensor arrangement comprising one or more sensors configured to facilitate inspection permits, for example, a pass/fail condition of damaged threads and/or doping application to be determined. The sensor arrangement may comprise one or more sensors configured to facilitate a gauging operation, including for example but not exclusively pipe outer diameter, thread type, stick-up height, position offset and clearance.

This may involve a visual sensor arrangement such as the visual sensor arrangement described above, LASER/LIDAR sensors or other suitable sensor arrangement.

The sensor arrangement may comprise one or more sensors configured to facilitate an identification operation, for example but not exclusively permitting the reading of ID codes, recognition/distinction of objects, shapes e.g. for Anti Collision Systems, personnel detection and protection.

This may involve a visual sensor arrangement such as the visual sensor arrangement described above, LASER/LIDAR sensors or other suitable sensor arrangement.

Alternatively or additionally, the sensor arrangement may comprise one or more locator tag, e.g. an RFID tag, to identify components of the apparatus and their location.

At least part of the sensor arrangement may be provided on the end effector (or in embodiments comprising a plurality of manipulator arms at least one of the end effectors).

The sensor arrangement may be configured to identify an obstruction in a work envelope of the apparatus and output a signal indicating that the obstruction has been detected. The signal may be communicated to a control system for the apparatus. Beneficially, the apparatus may be configured with real-time obstruction monitoring, with the ability to halt a given work task in response to the signal indicating that an obstruction has been detected.

The apparatus may comprise, or may be operatively associated with, a self-calibration system.

The self-calibration system may be configured to adjust a working position of the apparatus and/or the position of a target (e.g. the pipe stick-up in well centre).

Beneficially, the self-calibration system may counter externally induced dynamic force components in real-time, e.g. as caused by external environmental forces (wind-load, rig-motions and -inclination) which may otherwise impose an offset to the working position of the apparatus and/or the position of a target (e.g. the pipe stick-up in well centre).

Control of the apparatus may be configured using compliant motion control. For example, through man-machine-guidance and lead through programming, the apparatus may be guided through a number of predefined sequences and thereby learn to perform new tasks and operations. Through compliant motion control, the apparatus may perform collaborative operations with other machinery on drill floor, and/or it may perform sporadic but safe man-machine cooperation with personnel working on the drill floor In particular embodiments, the apparatus may be programmed in a non-proprietary industrial programming language while incorporating necessary security against harmful breach and data theft.

The apparatus may comprise an anchor arrangement.

The anchor arrangement may be configured to anchor the apparatus at a given location on the drill floor, e.g. at the storage location, at the deployed location or at the intermediate location.

The anchor arrangement may comprise one or more locking pins or the like.

The locking pins may be configured to extend from the apparatus to engage and lock the apparatus to the drill floor.

The anchor arrangement may comprise a wedge lock arrangement.

The one or more locking pins may engage the wedge lock arrangement to lock the apparatus to the drill floor.

The apparatus may comprise, may be coupled to, or operatively associated with a slewing arrangement.

The slewing arrangement may enable the apparatus to reorient itself towards and between the working area and adjacent areas for storage of various drilling tools, -subs or tubular elements and areas for storage of alternative robotic tools and manipulator heads etc. used for the various work tasks as defined for the robot.

According to a second aspect, there is provided a system comprising the apparatus of the first aspect.

The system may comprise a docking station for the apparatus.

The docking station may be located on the drill floor or elsewhere.

The system may comprise an electrical charging station for the apparatus.

The electrical charging station may be located on the drill floor or elsewhere.

The electrical charging station may be located at the docking station.

The system may comprise a winch.

In use, it is envisaged that the SWL-rating of the apparatus will be such that as is necessary for the machine to be able to replace manual work processes normally performed by one or more personnel working around the work-centre—e.g. typically in the range of a few hundred kilos, but significantly less than a thousand kilos. The apparatus may be configured to have a safe working load (SWL) rating of between 100 kg and 1000 kg. For non-routine lifting of heavier items near or beyond the SWL-rating of the robot, the load of such items may be partly or entirely taken by a drill floor winch/tugger-line or by other means of hoisting or load carrying, while being guided into the work center position by the robot arm(s).

The system may comprise a control system.

The control system may comprise a controller, e.g. a PLC.

In particular embodiments, the controller may be disposed externally to the apparatus, e.g. in the local equipment room (LER) or operator console. Beneficially, by locating the controller external to the apparatus work on the controller can be carried in a protected/controlled environment.

The system may comprise an anti-collision system.

The anti-collision system may take the form of a virtual twin system or the like. Beneficially, the provision of an anti-collision system independent of the rig's control system controls access of the apparatus to the work area, or across the path of other machines based on "access-granted"/"access denied" principle, and without undue interference with the hierarchy of the rig's primary drilling and pipe handling systems.

The system may comprise a plurality of robotic apparatus.

The plurality of robots may be each working separately or as a collaborative robotic system.

The plurality of robotic apparatus may comprise apparatus according to the first aspect.

In use, two or more of the apparatus may collaborate to perform identical or distinct and complex tasks within the same operation and thereby providing greater flexibility and adaptability for unpredictable or unanticipated operations.

The drill floor may be equipped with transponders/transceivers which creates an X, Y local grid reference for the apparatus. In the grid, all obstructions may be surveyed in, i.e. machines, tools, constructions, etc. Additionally the grid may be able to dictate areas where the apparatus have access and where they do not have access.

As described above, the at least one manipulator arm of the apparatus is configured to manipulate one or more of tubing, tools and/or equipment on a drill floor or pipe deck of an oil and gas platform in order to perform a given drill floor operation As an alternative to or in addition to the sensor arrangement described above, in some embodiments one or more of the tubing, tools and/or equipment to be manipulated by the apparatus may comprise a sensor arrangement.

Beneficially, by providing a sensor arrangement on one or more of the tubing, tools and/or equipment to be manipulated by the apparatus, one of the tubing, tools and/or equipment may be used as a reference locator.

During stabbing, for example, sensors on both tools may establish connection when they reach the same X, Y position (but different Z position) according to the local grid reference. If this connection/line of sight between the sensors is obstructed or disturbed the apparatus may cease the activity in order to mitigate the risk of personnel injury and/or mechanical damage.

The system may comprise a personnel detection and protection system. The system may comprise one or more sensors for detecting the presence of human operators. The sensors can be proximity sensors, movement sensors, thermals can be any other sensor for detecting personnel. A detection signal may be issued and sent to the controller. On detection of personnel proximal to the apparatus, the controller may issue a stop command or movement command to move away from the detected personnel.

The system may comprise a single or a plurality of the robotic apparatus which work in man-machine collaboration.

A third aspect relates to use of the apparatus of the first aspect to perform one or more drill floor operations.

As described above, the apparatus is configured for the manipulation of tubing, tools and/or equipment on a drill floor or pipe deck of an oil and gas platform, while enhancing the safety and efficiency of operations.

The features defined above or below may be utilised, either alone or in combination with any other defined feature.

DETAILED DESCRIPTION OF THE DRAWINGS

Figure 1:
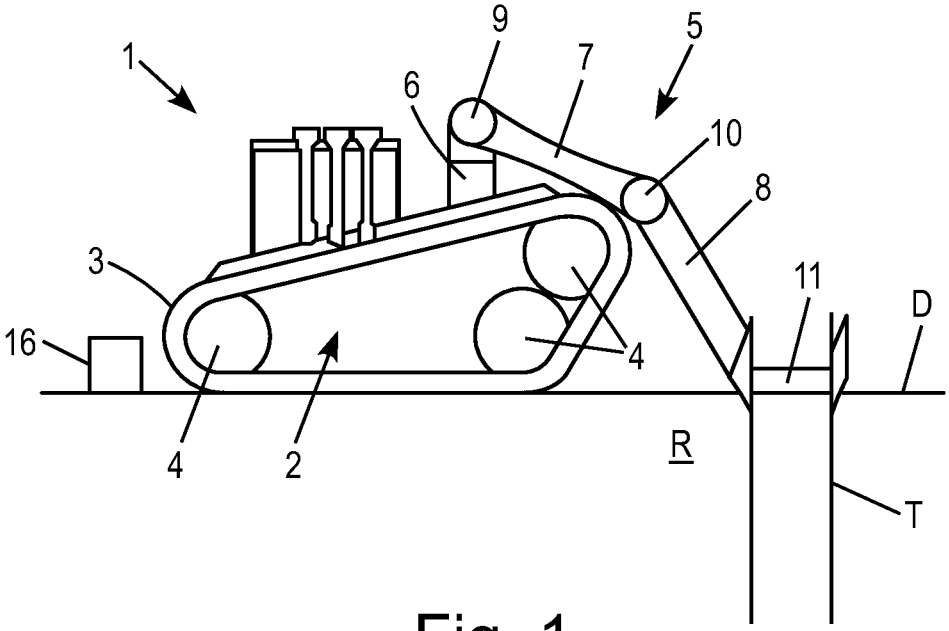
FIG. 1 shows a robotic apparatus for the manipulation of tubing, tools and/or equipment on a drill floor or pipe deck of an oil and gas platform.

FIG. 1 of the accompanying drawings shows a robotic apparatus 1 for the manipulation of tubing, tools and/or equipment on a drill floor D of an oil and gas rig R.

In use, the apparatus 1 is utilised to replace the manual operation of safety clamps and slips, e.g. when handling drill collars and bottom hole assemblies through the rotary.

As shown in FIG. 1, the apparatus 1 comprises a support arrangement in the form of an undercarriage 2. In the illustrated apparatus 1, the undercarriage 2 is movable relative to the drill floor D and takes the form of a continuous track system having a track 3 which in use is driven by a number of wheels 4. In the illustrated apparatus 1, the track 3 is formed using interconnected chain links (not shown) and the wheels 4 take the form of sprocket wheels. However, it will be recognised that other drive arrangements may be provided.

A manipulator arm 5 is coupled to the undercarriage 2. The manipulator arm 5 comprises a body 6 for coupling the manipulator arm 5 to the undercarriage 2, a first linkage element 7 and a second linkage element 8. The first linkage element 7 is coupled to the body 6 by an actuator 9. The actuator 9 provides a first degree of freedom of the manipulator arm 5. In the illustrated apparatus 1, the actuator 10 takes the form of a rotary actuator. The second linkage element 8 is coupled to the first linkage element 7 by an actuator 10. The actuator 10 provides a second degree of freedom of the manipulator arm 5. In the illustrated apparatus 1, the actuator 10 takes the form of a rotary actuator.

Figure 2:
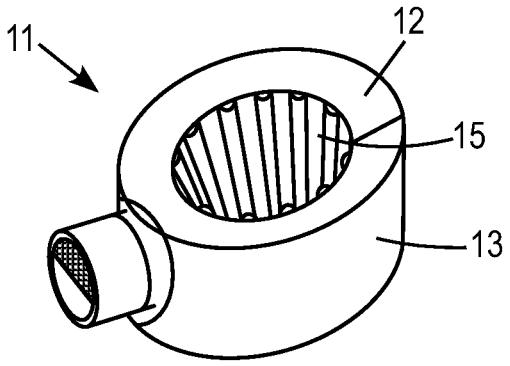
FIG. 2 shows an enlarged perspective view of an end effector of the apparatus shown in FIG. 1.
Figure 3:
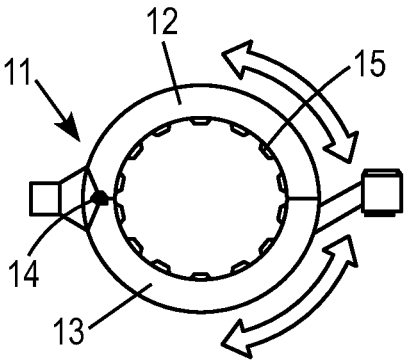
FIG. 3 shows an enlarged plan view of the end effector of the apparatus shown in FIG. 1.

As shown in FIG. 1, and referring also to FIGS. 2 and 3 of the accompanying drawings, an end effector—which in the illustrated apparatus 1 takes the form of a clamping tool 11—is connected at a distal end of the manipulator arm 5.

As shown in FIGS. 2 and 3, the clamping tool 11 comprises a first jaw portion 12 and a second jaw portion 13. The first jaw portion 12 and the second jaw portion 13 are pivotably coupled together at hinge 14.

In use, the clamping tool 11 is reconfigurable between an open configuration which facilitates location of the clamping tool 11 about a tubing section T and a closed configuration (as shown in FIGS. 2 and 3) permitting the clamping tool 11 to be secured about the tubing section T. The clamping tool 11 further comprises or is coupled to slips 15 for gripping the tubing section 19. In the illustrated apparatus 1, the slips 15 form part of the clamping tool 11. A lower section of the clamping tool 11 is tapered, providing a guide for location of another tubing section onto the tubing section T (as will be described further below).

In use, the undercarriage 2 is moveable across the drill floor D from a first, storage, position to a second, deployed, position (as shown in FIG. 1). In the second, deployed, position the manipulator arm 5 and clamping tool 11 are operable to engage and hold down the slips 15 until there is sufficient weight on the tubing section T to force the tubing section T down into the slips 15.

Figure 4:
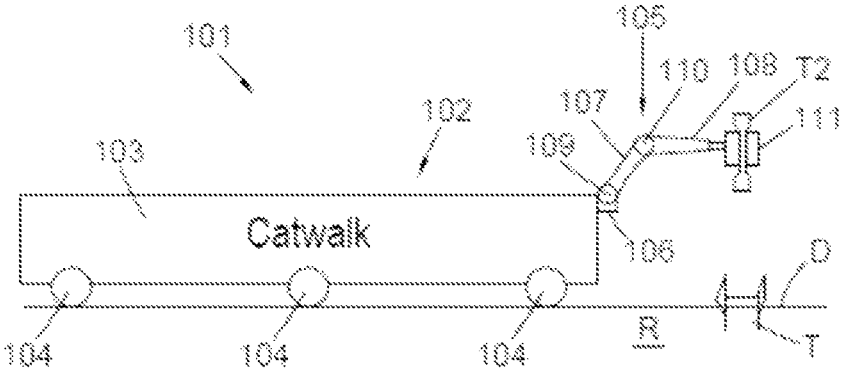
FIG. 4 shows an alternative robotic apparatus for the manipulation of tubing, tools and/or equipment on a drill floor or pipe deck of an oil and gas platform.

FIG. 4 of the accompanying drawings shows a robotic apparatus 101 for the manipulation of tubing, tools and/or equipment on the drill floor D.

As shown in FIG. 4, the apparatus 101 comprises a support arrangement which in the illustrated apparatus 101 takes the form of a catwalk 102. The catwalk 102 comprises a platform 103 and is supported on the drill floor D by a number of wheels 104.

In use, the apparatus 101 is utilised to replace the manual handling and installation of drill pipe, casing, pup joints, crossovers or the use of lifting-subs where these are being installed inside the tubulars while on the drill floor 2.

As shown in FIG. 4, a manipulator arm 105 is coupled to the catwalk 102. The manipulator arm 105 comprises a body 106 for coupling the manipulator arm 105 to the catwalk 102, a first linkage element 107 and a second linkage element 108. The first linkage element 107 is coupled to the body 106 by an actuator 109. The actuator 109 provides a first degree of freedom of the manipulator arm 105. In the illustrated apparatus 101, the actuator 109 takes the form of a rotary actuator. The second linkage element 108 is coupled to the first linkage element 107 by an actuator 110. The actuator 110 provides a second degree of freedom of the manipulator arm 105. In the illustrated apparatus 101, the actuator 110 takes the form of a rotary actuator.

Figure 5:
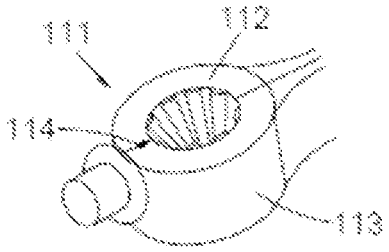
FIG. 5 shows an enlarged perspective view of an end effector of the apparatus shown in FIG. 4.
Figure 6:
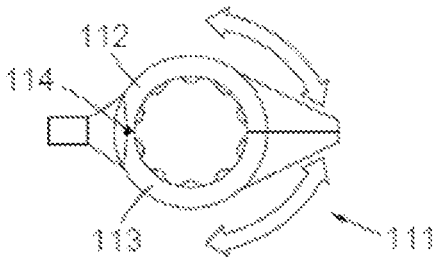
FIG. 6 shows an enlarged plan view of the end effector of the apparatus shown in FIG. 4.

As shown in FIG. 4, and referring also to FIGS. 5 and 6 of the accompanying drawings, an end effector—which in the illustrated apparatus 101 takes the form of a tubing handling tool 111—is connected at a distal end of the manipulator arm 105.

As shown in FIGS. 5 and 6, the tubing handling tool 111 comprises a first jaw portion 112 and a second jaw portion 113. The first jaw portion 112 and the second jaw portion 113 are pivotably coupled together at hinge 114.

In use, the catwalk 102 is moveable across the drill floor D from a first, storage, position to a second, deployed, position (as shown in FIG. 4). In the second, deployed, position the manipulator arm 105 and tubing handling tool 111 are operable to engage and manipulate a tubing section, in the illustrated apparatus 101 a pup joint T2, so as to locate the pup joint T2 on a tubing section T.

In order to engage and manipulate the pup joint T2 the tubing handling tool 111 is reconfigurable between an open configuration and a closed configuration (as shown in FIGS. 5 and 6) permitting the tubing handling tool 111 to securely grasp pup joint T2.

Figure 7:
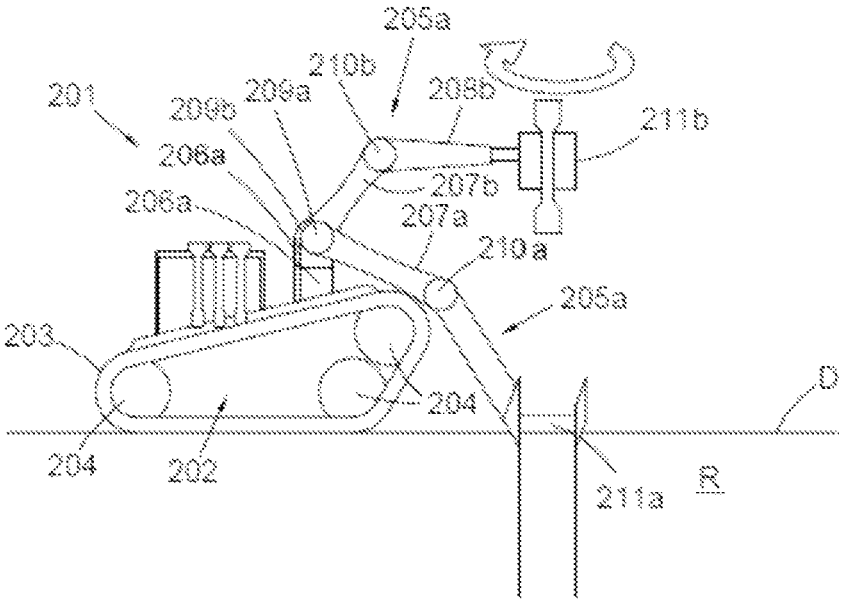
FIG. 7 shows an alternative robotic apparatus for the manipulation of tubing, tools and/or equipment on a drill floor or pipe deck of an oil and gas platform.

FIG. 7 of the accompanying drawings shows an alternative robotic apparatus 201 for the manipulation of tubing, tools and/or equipment on the drill floor D.

In use, the apparatus 201 is utilised to replace the manual operation of safety clamps and slips when handling drill collars and bottom hole assemblies through the rotary and to replace the manual handling and installation of drill pipe, casing, pup joints, crossovers or the use of lifting-subs where these are being installed inside the tubulars while on the drill floor D.

As shown in FIG. 7, the apparatus 201 comprises a support arrangement in the form of an undercarriage 202. In the illustrated apparatus 201, the undercarriage 202 is movable relative to the drill floor D and takes the form of a continuous track system having a track 203 which in use is driven by a number of wheels 204. In the illustrated apparatus 201, the track 203 is formed using interconnected chain links (not shown) and the wheels 204 take the form of sprocket wheels. However, it will be recognised that other drive arrangements may be provided.

As shown in FIG. 7, the apparatus 201 comprises two manipulator arms in the form of a first manipulator arm 205*a* and a second manipulator arm 205*b* coupled to the undercarriage 202.

The first manipulator arm 205*a* is coupled to the undercarriage 202. The first manipulator arm 205*a* comprises a body 206*a* for coupling the manipulator arm 205*a* to the undercarriage 202, a first linkage element 207*a* and a second linkage element 208*a*. The first linkage element 207*a* is coupled to the body 206*a* by an actuator 209*a*. The actuator 209*a* provides a first degree of freedom of the manipulator arm 205*a*. In the illustrated apparatus 201, the actuator 209*a* takes the form of a rotary actuator. The second linkage element 208*a* is coupled to the first linkage element 207*a* by an actuator 210*a*. The actuator 210*a* provides a second degree of freedom of the manipulator arm 205*a*. In the illustrated apparatus 201, the actuator 210*a* takes the form of a rotary actuator.

Figure 8:
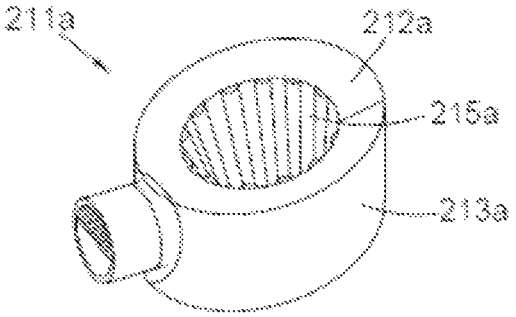
FIG. 8 shows an enlarged perspective view of a first end effector of the apparatus shown in FIG. 7.
Figure 9:
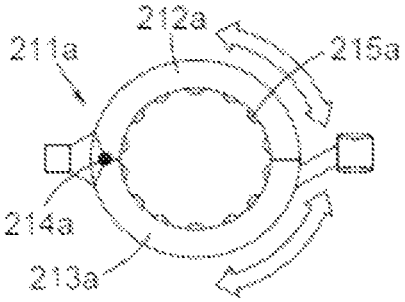
FIG. 9 shows an enlarged plan view of the first end effector of the apparatus shown in FIG. 7.

As shown in FIG. 7, and referring also to FIGS. 8 and 9 of the accompanying drawings, an end effector—which in the illustrated apparatus 201 takes the form of a clamping tool 211*a*—is connected at a distal end of the manipulator arm 205*a*.

As shown in FIGS. 8 and 9, the clamping tool 211*a* comprises a first jaw portion 212*a* and a second jaw portion 213*a*. The first jaw portion 212*a* and the second jaw portion 213*a* are pivotably coupled together at hinge 214*a*.

In use, the damping tool 211*a* is reconfigurable between an open configuration which facilitates location of the clamping tool 211*a* about a tubing section T and a closed configuration (as shown in FIGS. 8 and 9) permitting the clamping tool 211*a* to be secured about the tubing section T. The clamping tool 211*a* further comprises or is coupled to slips 215*a* for gripping the tubing section T. In the illustrated apparatus 201, the slips 215*a* form part of the clamping tool 211*a*. A lower section of the clamping tool 211*a* is tapered, providing a guide for location of another tubing section onto the tubing section T (as will be described further below).

The manipulator arm 205*b* comprises a body 206*b* for coupling the manipulator arm 205*b* to the undercarriage 202, a first linkage element 207*b* and a second linkage element 208*b*. The first linkage element 207*b* is coupled to the body 206*b* by an actuator 209*b*. The actuator 209*b* provides a first degree of freedom of the manipulator arm 105. In the illustrated apparatus 201, the actuator 209*b* takes the form of a rotary actuator. The second linkage element 208*b* is coupled to the first linkage element 207*b* by an actuator 210*b*. The actuator 210*b* provides a second degree of freedom of the manipulator arm 205*b*. In the illustrated apparatus 201, the actuator 210*b* takes the form of a rotary actuator.

Figure 10:
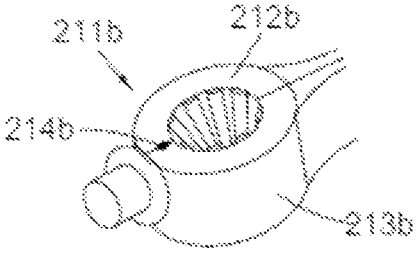
FIG. 10 shows an enlarged perspective view of a second end effector of the apparatus shown in FIG. 7.
Figure 11:
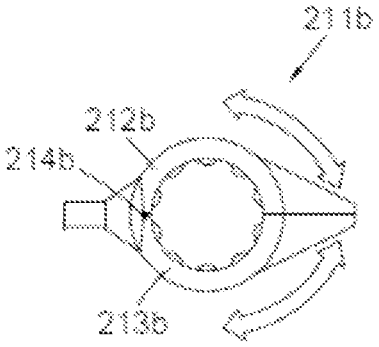
FIG. 11 shows an enlarged plan view of the second end effector of the apparatus shown in FIG. 7.

As shown in FIG. 7, and referring also to FIGS. 10 and 11 of the accompanying drawings, an end effector—which in the illustrated apparatus 201 takes the form of a tubing handling tool 211*b*—is connected at a distal end of the manipulator arm 205*b*.

As shown in FIGS. 10 and 11, the tubing handling tool 211*b* comprises a first jaw portion 212*b* and a second jaw portion 213*b*. The first jaw portion 212*b* and the second jaw portion 213*b* are pivotably coupled together at hinge 214*b*.

In use, the undercarriage 202 is moveable across the drill floor D from a first, storage, position to a second, deployed, position (as shown in FIG. 7). In the second, deployed, position the manipulator arm 205*a* and clamping tool 211*a* are operable to engage and hold down the slips 215*a* until there is sufficient weight on the tubing section T to force the tubing section T down into the slips 215*a*.

The manipulator arm 205*b* and the tubing handling tool 211*b* are operable to engage and manipulate a tubing section, in the illustrated apparatus 201 a crossover T2, so as to locate the crossover T2 on the tubing section T.

In order to engage and manipulate the crossover T2 the tubing handling tool 211*b* is reconfigurable between an open configuration and a closed configuration (as shown in FIGS. 10 and 11) permitting the tubing handling tool 211*b* to securely grasp crossover T2.

Beneficially, the apparatus 201 facilitates rapid and accurate location of the crossover T2 onto the tubing section T, since when the first manipulator arm 205*a* is engaged, the position of the apparatus 201 on the drill floor D is known and can be used to facilitate the accurate positioning and manipulation of the second manipulator arm 205*b* and crossover T2.

Figure 12:
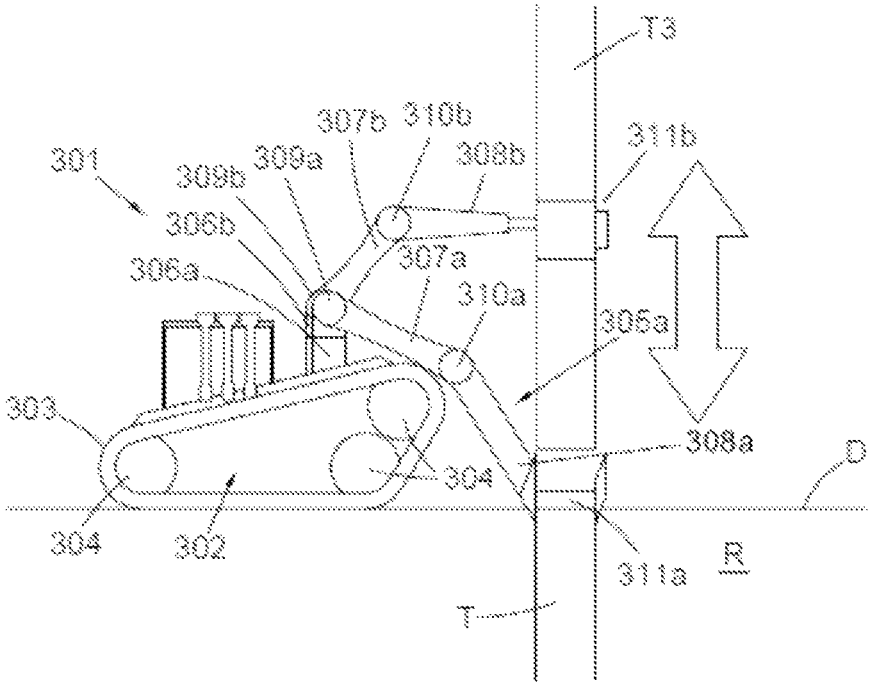
FIG. 12 shows an alternative robotic apparatus for the manipulation of tubing, tools and/or equipment on a drill floor or pipe deck of an oil and gas platform.

FIG. 12 of the accompanying drawings shows an alternative robotic apparatus 301 for the manipulation of tubing, tools and/or equipment on the drill floor D.

In use, the apparatus 301 is utilised to replace the manual operation of safety clamps and slips and to replace the manual alignment/guidance and thread alignment (doping") of connections of drill pipe, casing, pup joints, and crossovers.

As shown in FIG. 12, the apparatus 301 comprises a support arrangement in the form of an undercarriage 302. In the illustrated apparatus 301, the undercarriage 302 is movable relative to the drill floor D and takes the form of a continuous track system having a track 303 which in use is driven by a number of wheels 304. In the illustrated apparatus 301, the track 303 is formed using interconnected chain links (not shown) and the wheels 304 take the form of sprocket wheels. However, it will be recognised that other drive arrangements may be provided.

As shown in FIG. 12, the apparatus 301 comprises two manipulator arms in the form of a first manipulator arm 305*a* and a second manipulator arm 305*b* coupled to the undercarriage 302.

The first manipulator arm 305*a* is coupled to the undercarriage 302. The first manipulator arm 305*a* comprises a body 306*a* for coupling the manipulator arm 305*a* to the undercarriage 302, a first linkage element 307*a* and a second linkage element 308*a*. The first linkage element 307*a* is coupled to the body 306*a* by an actuator 309*a*. The actuator 309*a* provides a first degree of freedom of the manipulator arm 305*a*. In the illustrated apparatus 301, the actuator 309*a* takes the form of a rotary actuator. The second linkage element 308*a* is coupled to the first linkage element 307*a* by an actuator 310*a*. The actuator 310*a* provides a second degree of freedom of the manipulator arm 305*a*. In the illustrated apparatus 301, the actuator 310*a* takes the form of a rotary actuator.

As shown in FIG. 12, an end effector—which in the illustrated apparatus 301 takes the form of a clamping tool 311*a*—is connected at a distal end of the manipulator arm 205*a*.

Figure 13:
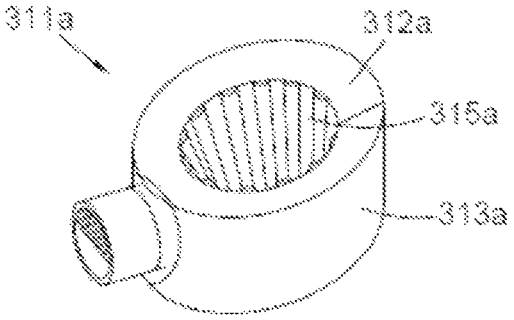
FIG. 13 shows an enlarged perspective view of a first end effector of the apparatus shown in FIG. 12.
Figure 14:
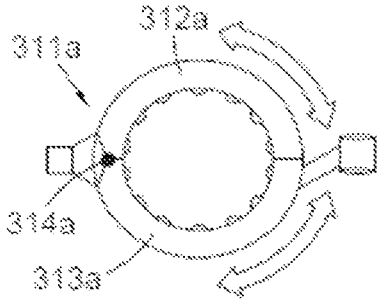
FIG. 14 shows an enlarged plan view of the first end effector of the apparatus shown in FIG. 12.
Figure 15:
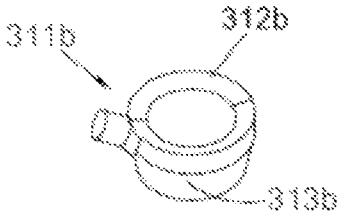
FIGS. 15 to 18 a second end effector of the apparatus shown in FIG. 12.
Figure 16:
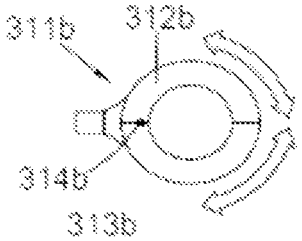
Figure 17:
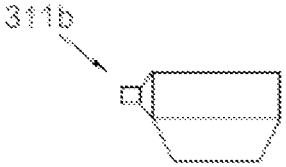
Figure 18:
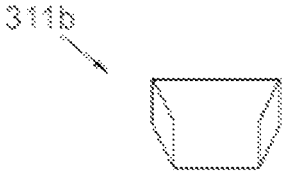

As shown in FIGS. 13 and 14, the clamping tool 311*a* comprises a first jaw portion 312*a* and a second jaw portion 313*a*. The first jaw portion 312*a* and the second jaw portion 313*a* are pivotably coupled together at hinge 314*a*. The clamping tool 311*a* further comprises or is coupled to slips 315*a* for gripping the tubing section, which in the illustrated apparatus 301 takes the form of a pup joint T2. In the illustrated apparatus 301, the slips 215*a* form part of the clamping tool 311*a*.

The second manipulator arm 305*b* comprises a body 306*b* for coupling the manipulator arm 305*b* to the undercarriage 302, a first linkage element 307*b* and a second linkage element 308*b*. The first linkage element 307*b* is coupled to the body 306*b* by an actuator 309*b*. The actuator 309*b* provides a first degree of freedom of the manipulator arm 305*b*. In the illustrated apparatus 301, the actuator 309*b* takes the form of a rotary actuator. The second linkage element 308*b* is coupled to the first linkage element 307*b* by an actuator 310*b*. The actuator 310*b* provides a second degree of freedom of the manipulator arm 305*b*. In the illustrated apparatus 301, the actuator 310*b* takes the form of a rotary actuator.

As shown in FIG. 12, and referring also to FIGS. 15 to 18, an end effector—which in the illustrated apparatus 301 takes the form of a guidance tool 311*b*—is connected at a distal end of the manipulator arm 305*b*.

As shown in FIGS. 15 to 18, the guidance tool 311*b* comprises a first jaw portion 312*b* and a second jaw portion 313*b*. The first jaw portion 312*b* and the second jaw portion 313*b* are pivotably coupled together at hinge 314*b*. As shown, the guidance tool 311*b* defines a funnel and beneficially, the apparatus 301 facilitates rapid and accurate location of a tubing section T3 onto tubing section T, since when the first manipulator arm 305*a* is engaged, the position of the apparatus 301 on the drill floor D is known and can be used to facilitate the accurate guidance of the second manipulator arm 305*b* and tubing section T3.

Figure 19:
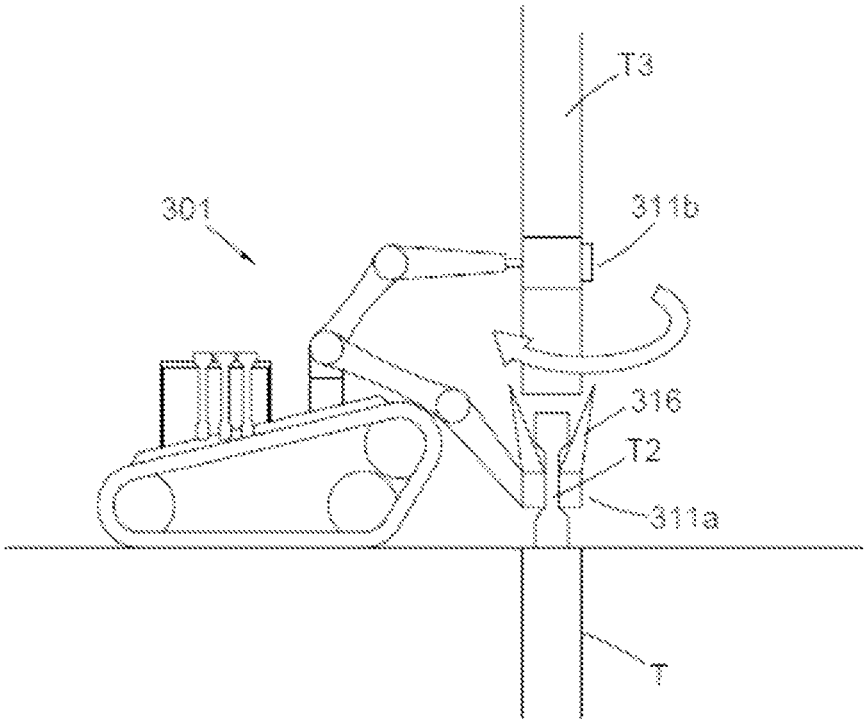
FIG. 19 shows an alternative application of the apparatus shown in FIG. 12.

FIG. 19 of the accompanying drawings shows an alternative application of the apparatus 301. As shown in FIG. 19, the apparatus 301 is configured to facilitate the guidance of tubing section T3 onto tubing section T2. To facilitate this, the clamping tool 311*a* also defines a guidance member 316 to assist in alignment of the tubing section T3 with the tubing section T2.

Figure 20:
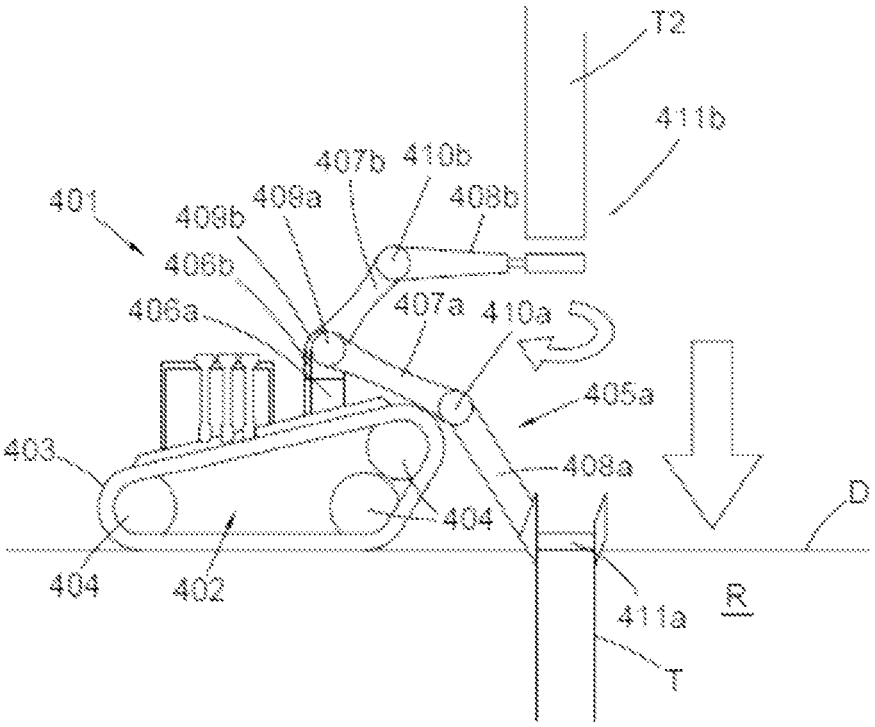
FIG. 20 shows an alternative robotic apparatus for the manipulation of tubing, tools and/or equipment on a drill floor or pipe deck of an oil and gas platform.

FIG. 20 of the accompanying drawings shows an alternative robotic apparatus 401 for the manipulation of tubing, tools and/or equipment on the drill floor D.

In use, the apparatus 401 is utilised to replace the manual operation of safety clamps and slips when handling drill collars and bottom hole assemblies through the rotary and to replace the manual operation of removal of thread protectors on the drill floor D.

As shown in FIG. 20, the apparatus 401 comprises a support arrangement in the form of an undercarriage 402. In the illustrated apparatus 401, the undercarriage 402 is movable relative to the drill floor D and takes the form of a continuous track system having a track 403 which in use is driven by a number of wheels 404. In the illustrated apparatus 401, the track 403 is formed using interconnected chain links (not shown) and the wheels 404 take the form of sprocket wheels. However, it will be recognised that other drive arrangements may be provided.

As shown in FIG. 20, the apparatus 401 comprises two manipulator arms in the form of a first manipulator arm 405*a* and a second manipulator arm 405*b* coupled to the undercarriage 402.

The first manipulator arm 405*a* is coupled to the undercarriage 402. The first manipulator arm 405*a* comprises a body 406*a* for coupling the manipulator arm 405*a* to the undercarriage 402, a first linkage element 407*a* and a second linkage element 408*a*. The first linkage element 407*a* is coupled to the body 406*a* by an actuator 409*a*. The actuator 409*a* provides a first degree of freedom of the manipulator arm 405*a*. In the illustrated apparatus 401, the actuator 409*a* takes the form of a rotary actuator. The second linkage element 408*a* is coupled to the first linkage element 407*a* by an actuator 410*a*. The actuator 410*a* provides a second degree of freedom of the manipulator arm 405*a*. In the illustrated apparatus 401, the actuator 410*a* takes the form of a rotary actuator.

Figure 21:
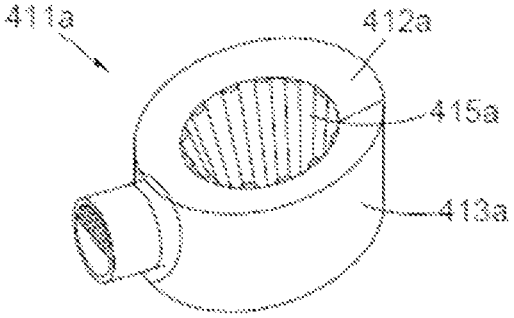
FIG. 21 shows an enlarged perspective view of a first end effector of the apparatus shown in FIG. 20.
Figure 22:
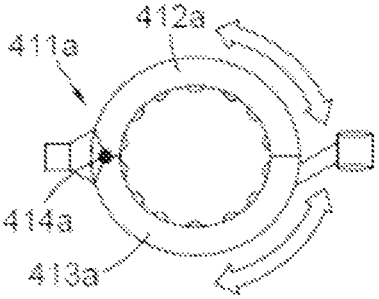
FIG. 22 shows an enlarged plan view of the first end effector of the apparatus shown in FIG. 20.
Figure 23:
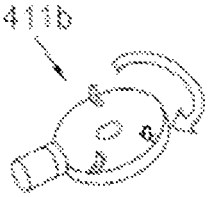
FIG. 23 shows an enlarged perspective view of a second end effector of the apparatus shown in FIG. 20.
Figure 24:
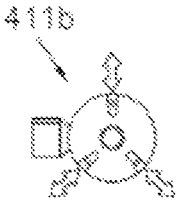
FIG. 24 shows an enlarged plan view of the second end effector of the apparatus shown in FIG. 20.

As shown in FIG. 20, and referring also to FIGS. 21 and 22 of the accompanying drawings, an end effector—which in the illustrated apparatus 401 takes the form of a clamping tool 411*a*—is connected at a distal end of the manipulator arm 405*a*.

As shown in FIGS. 21 and 22, the clamping tool 411*a* comprises a first jaw portion 412*a* and a second jaw portion 413*a*. The first jaw portion 412*a* and the second jaw portion 413*a* are pivotably coupled together at hinge 414*a*.

In use, the clamping tool 411*a* is reconfigurable between an open configuration which facilitates location of the clamping tool 411*a* about a tubing section T and a closed configuration (as shown in FIGS. 21 and 22) permitting the clamping tool 411*a* to be secured about the tubing section T. The clamping tool 411*a* further comprises or is coupled to slips 415*a* for gripping the tubing section T. In the illustrated apparatus 401, the slips 415*a* form part of the clamping tool 411*a*.

The manipulator arm 205*b* comprises an impact wrench tool 411*b* configured to remove the thread protector from the tubing section T2.

Beneficially, the apparatus 401 facilitates rapid and accurate location of the crossover T2 onto the tubing section T, since when the first manipulator arm 205*a* is engaged, the position of the apparatus 201 on the drill floor D is known and can be used to facilitate the accurate positioning and manipulation of the second manipulator arm 205*b* and crossover T2.

Figure 25:
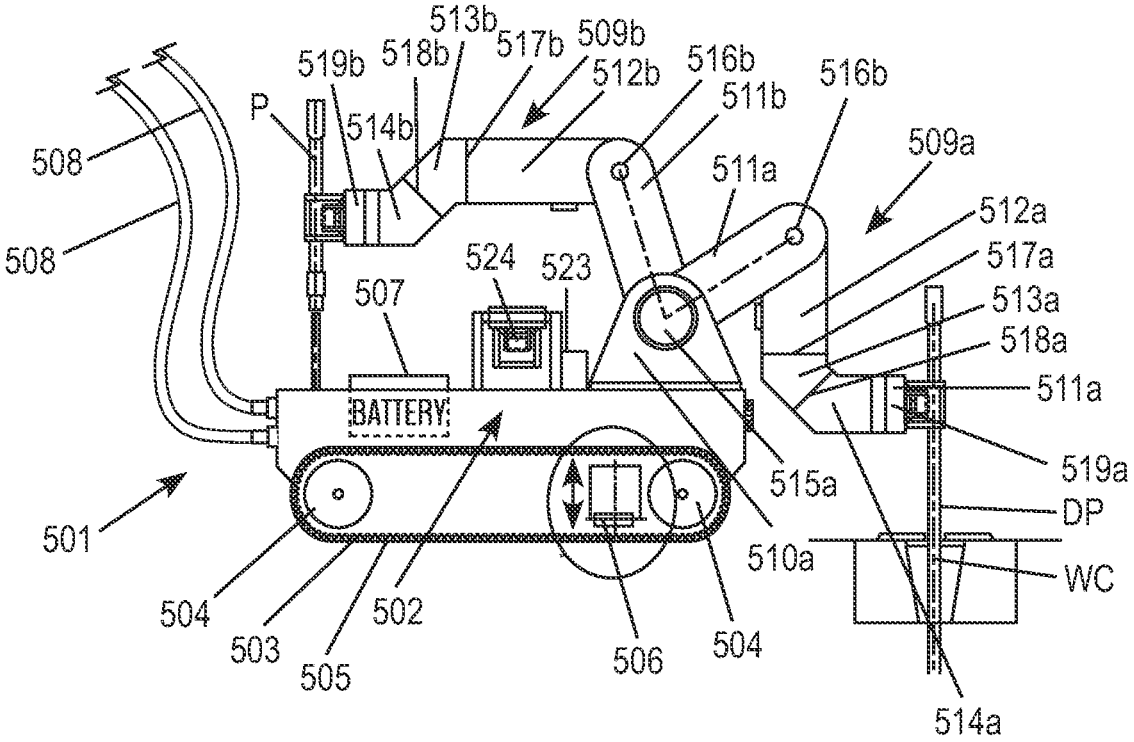
FIGS. 25, 26 and 27 show side, front and bottom views respectively of a robotic apparatus for the manipulation of tubing, tools and/or equipment on a drill floor or pipe deck of an oil and gas platform, performing a drill floor operation.
Figure 26:
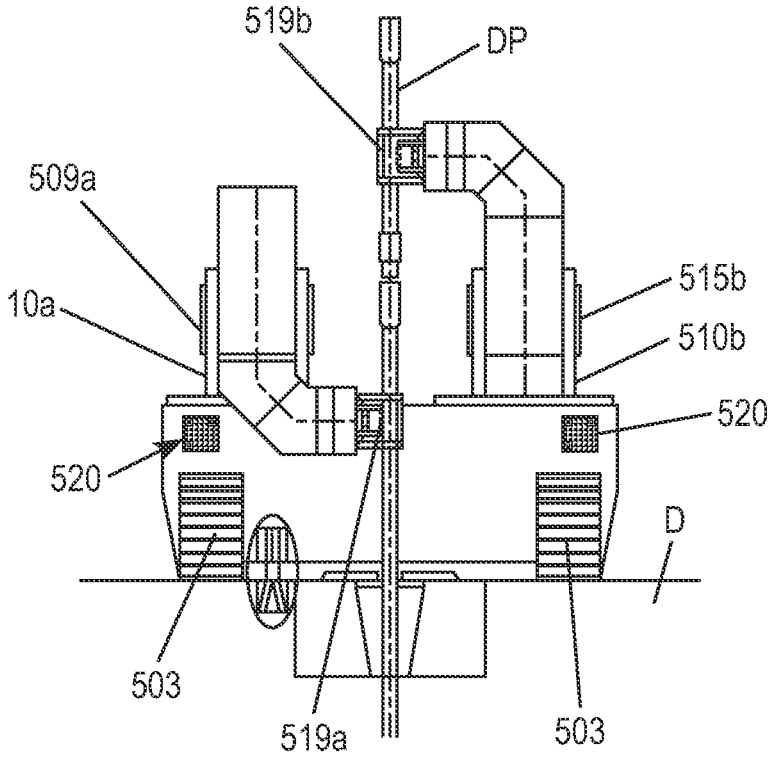
Figure 27:
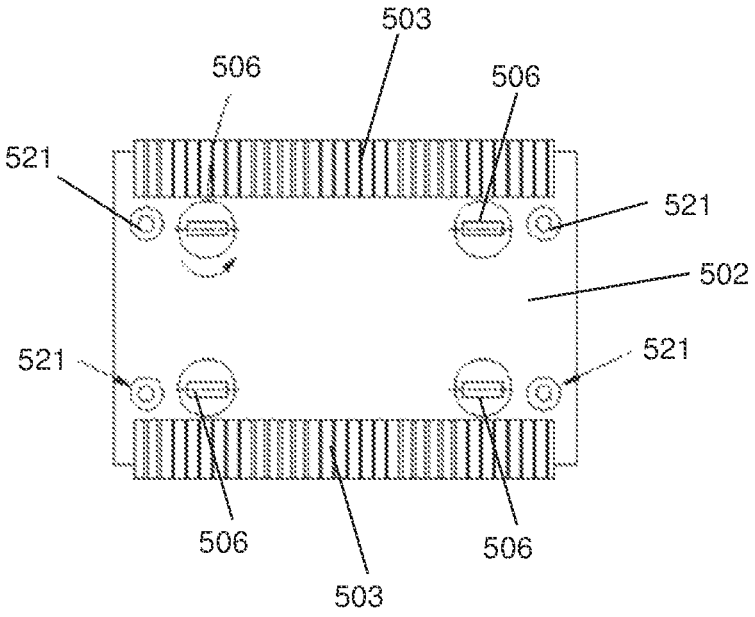
Figure 28:
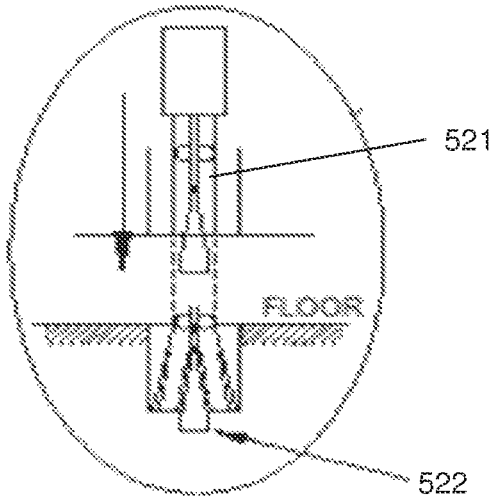
FIG. 28 shows an enlarged view of part of the apparatus shown in FIGS. 25 to 27.

Referring now to FIGS. 25 to 28 of the accompanying drawings, there is shown another robotic apparatus 501 for the manipulation of tubing, tools and/or equipment on the drill floor D. FIGS. 25, 26 and 27 show side, front and bottom views respectively of the robotic apparatus 501 and FIG. 28 shows an enlarged view of part of the apparatus 501 shown in FIG. 26.

As shown, the apparatus 501 comprises a support arrangement in the form of an undercarriage 502. In the illustrated apparatus 501, the undercarriage 502 is movable relative to the drill floor D and takes the form of a continuous track system having tracks 503 which are driven by wheels 504. In the illustrated apparatus 501, the tracks 503 are formed from interconnected chain links 504 while the wheels 504 take the form of sprocket wheels. It will be recognised, however, that other drive arrangements may be utilised.

In the illustrated apparatus 501, the apparatus 501 further additionally or alternatively comprises a number of omni-directional rollers 506 disposed in the undercarriage 502 (shown in FIGS. 25 and 27). Beneficially, the omni-directional rollers 506 facilitate movement of the apparatus 501 in any required direction, including forwards and/or backwards movements, lateral or sideways movements, diagonal movements and/or rotational movements. As such, the apparatus 501 is highly manoeuvrable around the drill floor D.

As shown in FIG. 25, the illustrated apparatus 501 utilises a hybrid power supply, having an onboard electrical power supply in the form of battery 507 and a hydraulic power supply view hydraulic lines 508. However, it will be recognised that other means of providing electrical and/or hydraulic power may be provided. For example, the apparatus 501 may alternatively or additionally be provided with a cabled electrical power supply, such as a drag chain power supply or the like.

Beneficially, the apparatus 501 is configured to utilise the onboard power supply in the form of battery 507 to manoeuvre from a charging/docking station which forms a storage location (not shown) to a work location around the well centre WC on the drill floor D (shown in FIGS. 25 and 26), the apparatus 501 configured to use electrical power and/or hydraulic power (from hydraulic lines 508) for the given work task itself.

As shown in FIGS. 25 and 26, the illustrated apparatus 501 comprises two manipulator arms in the form of a first manipulator arm 509*a* and a second manipulator arm 509*b*.

The first manipulator arm 509*a* is pivotably coupled to the undercarriage 502 by a base 510*a* while the second manipulator 509*b* is similarly coupled to the undercarriage 502 by base 510*b* (shown in FIG. 26).

As shown most clearly in FIG. 25, the first manipulator arm 509*a* comprises linkage elements 511*a*, 512*a*, 513*a*, 514*a*. Linkage element 511*a* is rotationally coupled to the base 510*a* by rotary actuator 515*a*. Linkage element 512*a* is rotationally coupled to linkage element 511*a* by rotary actuator 516*a*. Linkage element 513*a* is rotationally coupled to linkage element 512*a* by rotary actuator 517*a*. Linkage element 514*a* is rotationally coupled to linkage element 513*a* by rotary actuator 518*a*.

It will be recognised that manipulator arm 509*a* may alternatively comprise more or less linkage elements and actuators as required.

An end effector 519*a* is connected at a distal end of the manipulator arm 509*a*. In the illustrated apparatus 501, end effector 519*a* takes the form of a handling tool suitable for manipulating and connecting sections of drill pipe P.

As shown most clearly in FIG. 25, the second manipulator arm 509*b* comprises linkage elements 511*b*, 512*b*, 513*b*, 514*b*. Linkage element 511*b* is rotationally coupled to the base 510*b* by rotary actuator 515*b*. Linkage element 512*b* is rotationally coupled to linkage element 511*b* by rotary actuator 516*b*. Linkage element 513*b* is rotationally coupled to linkage element 512*b* by rotary actuator 517*b*. Linkage element 514*b* is rotationally coupled to linkage element 513*b* by rotary actuator 518*b*.

It will be recognised that manipulator arm 509*b* may alternatively comprise more or less linkage elements and actuators as required.

An end effector 519*b* is connected at a distal end of the manipulator arm 509*b*. In the illustrated apparatus 501, end effector 519*b* also takes the form of a handling tool suitable for manipulating and connecting sections of drill pipe DP.

In use, the apparatus 501 is configured to move between a storage position, e.g. a charging/docking station (not shown), and a deployed position located adjacent to the well centre WC (as shown in FIGS. 25 and 26).

A sensor arrangement includes sensors 520 to facilitate accurate location of the apparatus 501 at the well centre WC.

In the illustrated apparatus 501, the sensors 520 form part of a machine vision system which, using machine learning, facilitates reliable sensing and object detection and which controls both motion of the apparatus 501 around the drill floor D to/from the well centre WC and motion of the manipulator arms 509*a*, 509*b*.

However, as outlined above the sensors arrangement may be configured to perform other functions, such as facilitate inspection of tools, equipment or the apparatus 501 or its components; facilitate an identification operation, for example but not exclusively permitting the reading of ID codes, recognition/distinction of objects, shapes e.g. for ACS, personnel detection.

Referring now in particular to FIGS. 27 and 28, once located at the well centre WC, an anchor arrangement—which in the illustrated apparatus 501 takes the form of locking pins 521 disposed in the undercarriage 502—is configured to be activated. As shown in FIG. 28, when activated the locking pins 521 extend into the drill floor D and are secured by a wedge lock arrangement 522.

When the locking pins 521 are engaged with the drill floor D, the apparatus 501 has a fixed point of reference relative to the well centre WC. This means that the position of the apparatus 501 and the manipulator arms 509*a*, 509*b* is known with respect to the stick up and/or the well centre WC. Accordingly, the apparatus 501 can precisely move the effectors 519*b* and 519*b* and e.g. the drill pipe sections P. This means that the efficiency of assembly of the drill pipe sections is increased.

The manipulator arms 509*a*, 509*b* and end effectors 519*a*, 519*b* are then operated to manipulate the drill pipe sections DP in order to stab in and make up the necessary connection.

The illustrated apparatus 501 may further comprise an onboard rack 523 for tools—in the illustrated apparatus 501 another end effector 524, obviating the requirement for the apparatus 501 to return to the docking station (not shown) to be reconfigured for another operation.

Beneficially, the apparatus 501 may be adapted to perform a variety of drill floor operations, obviating the requirement for bespoke tools for each operation and reducing the space occupied on the drill floor.

For example, FIGS. 29 to 35 of the accompanying drawings show the apparatus 501 configured to perform a number of different drill floor operations.

Figure 29:
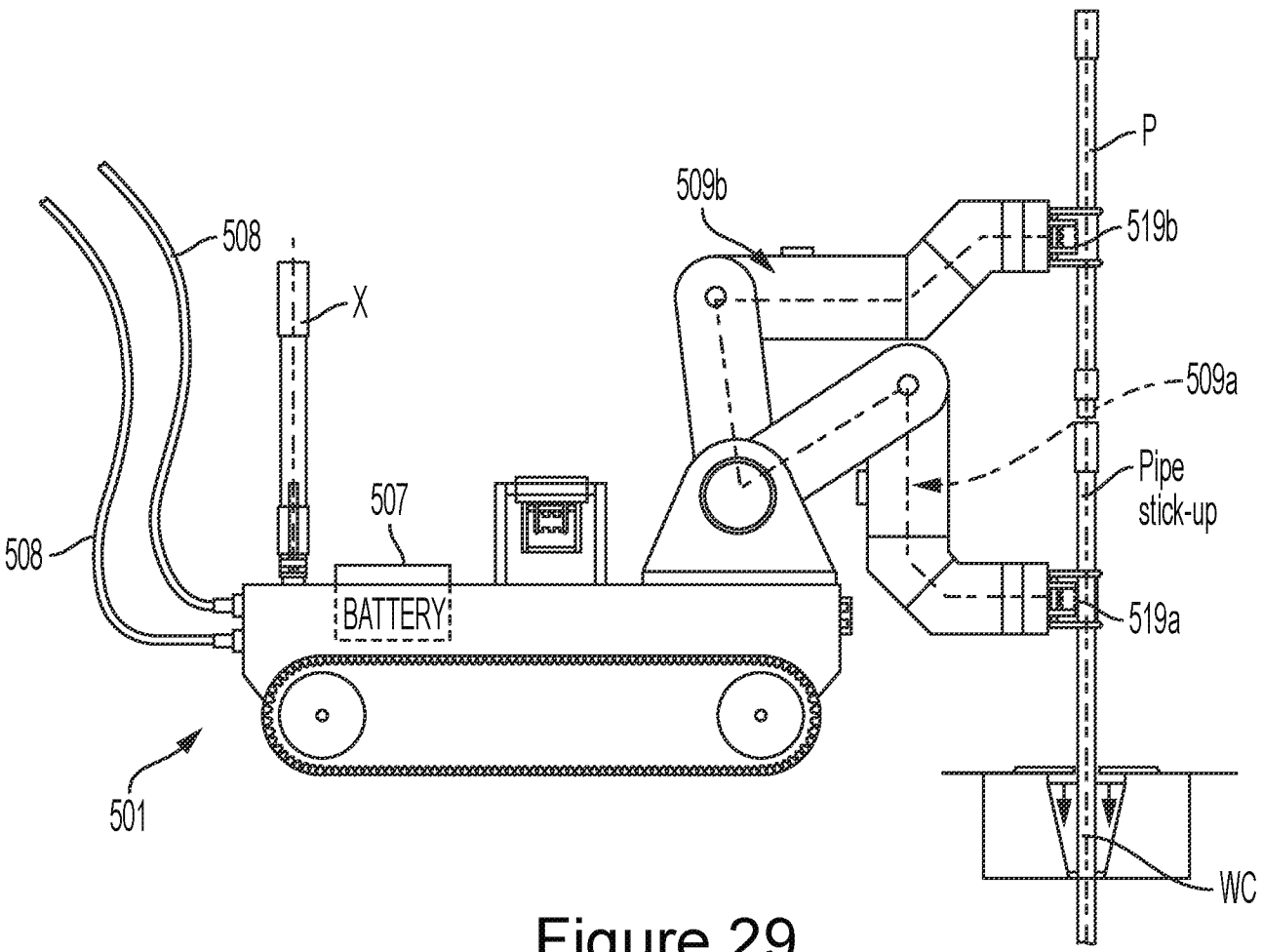
FIGS. 29 and 30 show side and front views respectively of a robotic apparatus for the manipulation of tubing, tools and/or equipment on a drill floor or pipe deck of an oil and gas platform, performing another drill floor operation.
Figure 30:
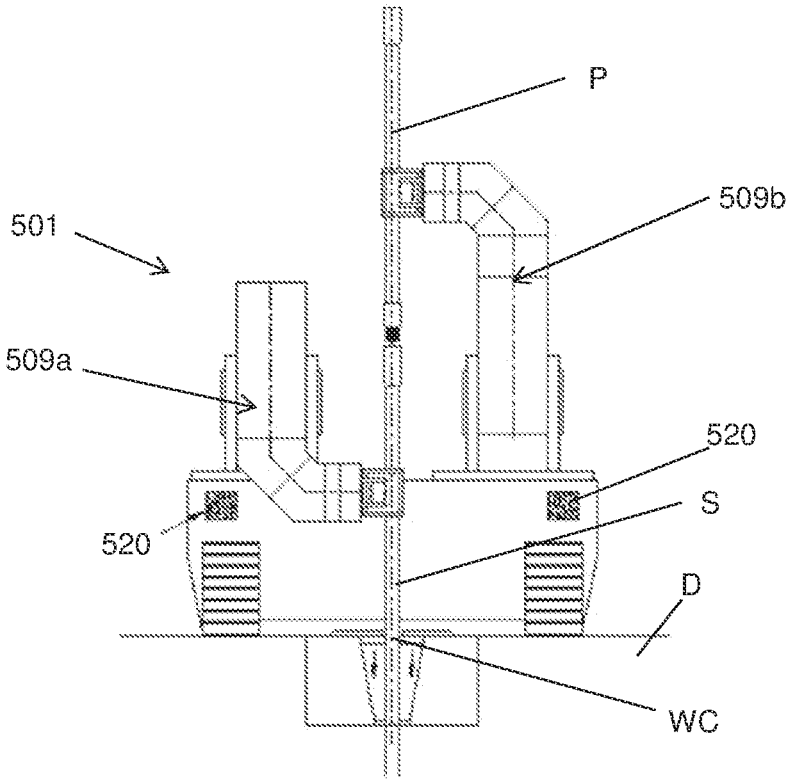

FIGS. 29 and 30 show the apparatus 501 performing the drill floor operation of manipulating drilling pup-joints P, drilling-subs S or cross-overs X.

The apparatus 501 is arranged and operated substantially as described above with reference to FIG. 25, the apparatus 501 configured to utilise the onboard power supply in the form of battery 507 to power the continuous track system and manoeuvre the apparatus 501 from the charging/docking station which forms the storage location (not shown) for the apparatus 501 to the work location around the well centre WC on the drill floor D, the apparatus 501 configured to use electrical power (in this embodiment from battery 507) and/or hydraulic power (from hydraulic lines 508) for the given work task itself.

Once located at the well centre WC, the locking pins 521 disposed in the undercarriage 502 are activated to extend into the drill floor D and are secured by the wedge lock arrangement 522.

The manipulator arms 509*a*, 509*b* and end effectors 519*a*, 519*b* are then operated to manipulate a pup-joint P (or a crossover X) in order to stab in and make up the necessary connection with the pipe stick-up in the well centre.

The end-effector 519*a* in this example is used for providing a reference position and possible offset/inclination of the pipe in the well centre WC in order to accurately align the pup-joint P with the pipe, while the optical sensors 520 will provide input of the vertical height of the pipe stick-up.

The end effectors 519*a*, 519*b* described above with reference to FIG. 25 are also used for this operation, although it will be recognised that alternative end effectors may be utilised where appropriate.

Figure 31:
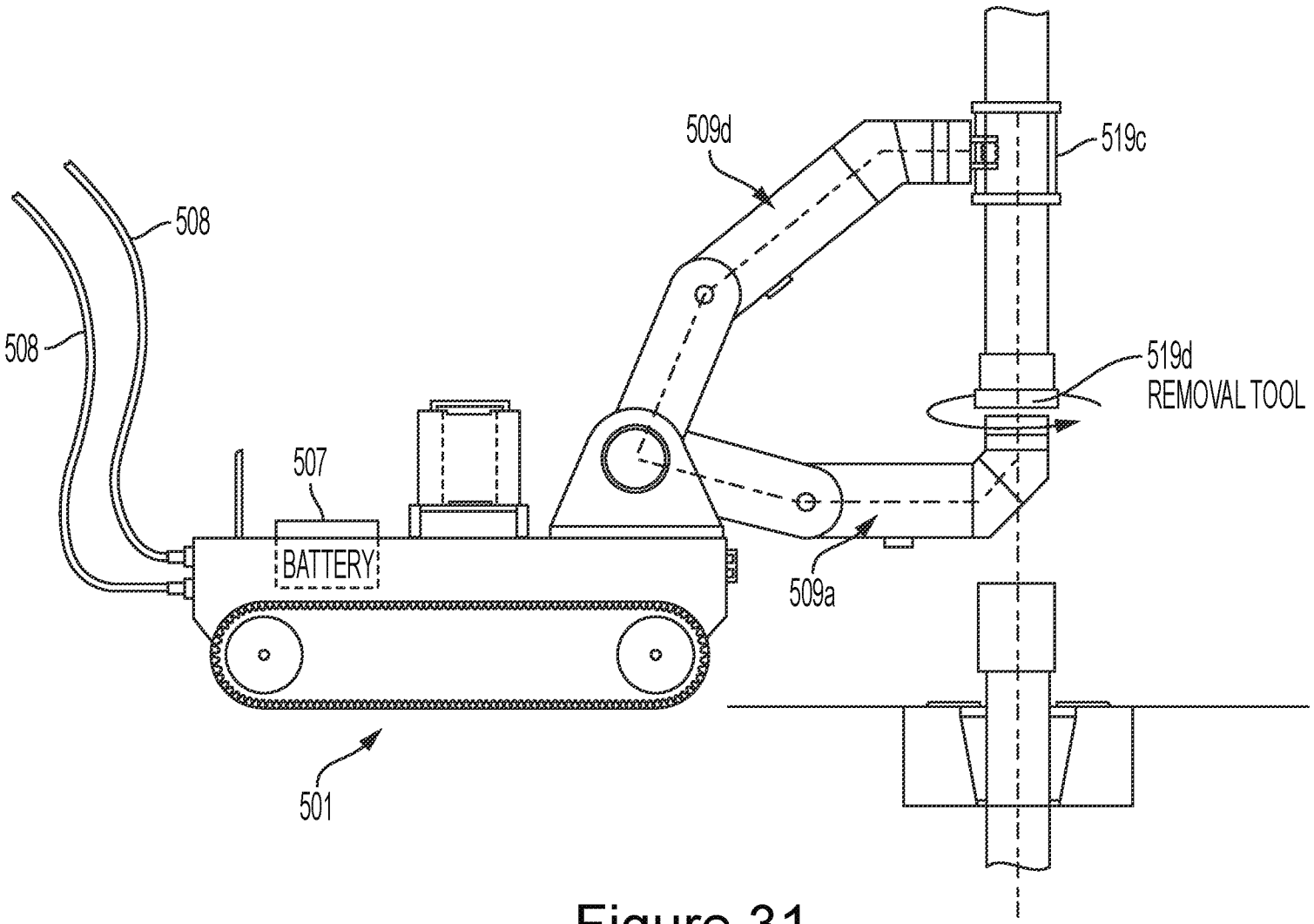
FIG. 31 shows a side view of a robotic apparatus for the manipulation of tubing, tools and/or equipment on a drill floor or pipe deck of an oil and gas platform, performing another drill floor operation.

FIG. 31 shows the apparatus 501 in an alternative configuration in order to perform the drill floor operation of thread protector removal.

As shown, the apparatus 501 is arranged and operated substantially as described above with reference to FIG. 25. However, in this embodiment the end effectors 519*a* has been replaced with a casing handling tool 519*c* and the end effector 519*b* has been replaced with a thread protector removal tool 519*d*.

In use, the apparatus 501 is configured to utilise the onboard power supply in the form of battery 507 to power the continuous track system and manoeuvre the apparatus 501 from the charging/docking station which forms the storage location (not shown) for the apparatus 501 to the work location around the well centre WC on the drill floor D, the apparatus 501 configured to use electrical power (in this embodiment from battery 507) and/or hydraulic power (from hydraulic lines 508) for the given work task itself.

Once located at the well centre WC, the locking pins 521 disposed in the undercarriage 502 are activated to extend into the drill floor D and are secured by the wedge lock arrangement 522.

The manipulator arms 509*a*, 509*b* and end effectors 519*c*, 519*d* are then operated to hold the casing (using end effector 519*c*) and rotate the thread protector removal tool 519*d* to remove the thread protector.

Figure 32:
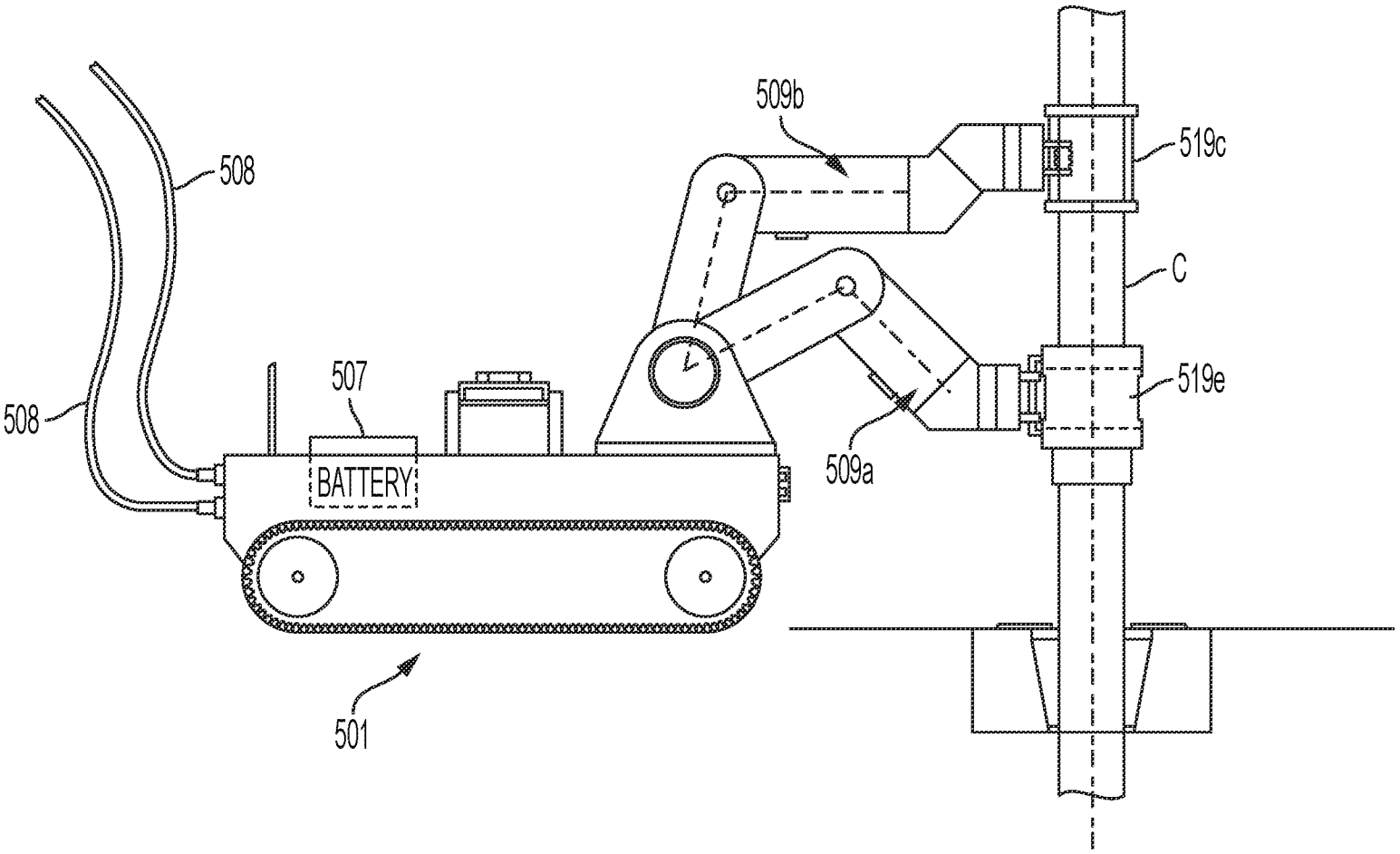
FIG. 32 shows a side view of a robotic apparatus for the manipulation of tubing, tools and/or equipment on a drill floor or pipe deck of an oil and gas platform, performing another drill floor operation.

FIG. 32 shows the apparatus 501 configured to perform the drill floor operation of casing stabbing.

As shown, the apparatus 501 is arranged and operated substantially as described above with reference to FIG. 25. However, in this embodiment the end effectors 519*a* has been replaced with casing handling tool 519*c* and the end effector 519*b* has been replaced with casing stabbing tool 519*e*.

In use, the apparatus 501 is configured to utilise the onboard power supply in the form of battery 507 to power the continuous track system and manoeuvre the apparatus 501 from the charging/docking station which forms the storage location (not shown) for the apparatus 501 to the work location around the well centre WC on the drill floor D, the apparatus 501 configured to use electrical power (in this embodiment from battery 507) and/or hydraulic power (from hydraulic lines 508) for the given work task itself.

Once located at the well centre WC, the locking pins 521 disposed in the undercarriage 502 are activated to extend into the drill floor D and are secured by the wedge lock arrangement 522.

The manipulator arms 509*a*, 509*b* and end effectors 519*c*, 519*e* are then operated to hold the casing (using end effector 519*c*) and stab in the casing C using tool 519*e*.

Figure 33:
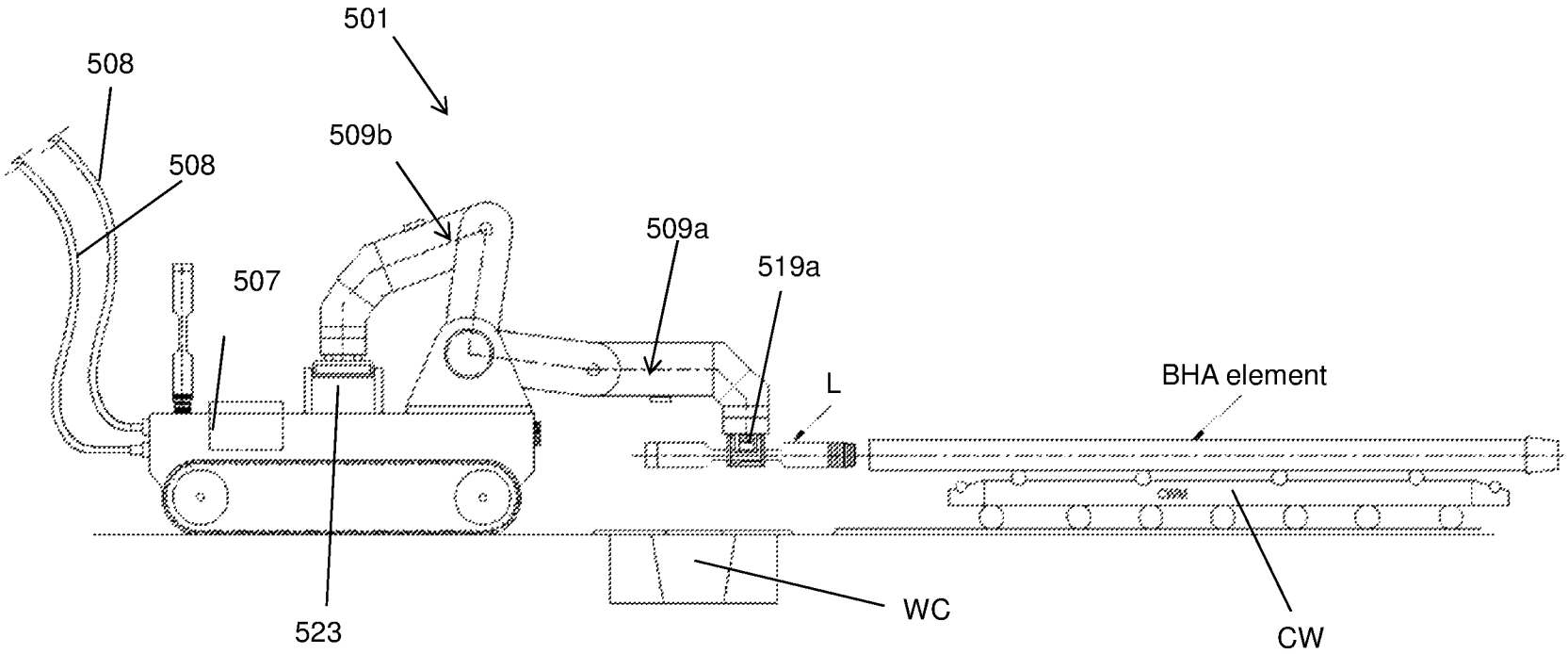
FIG. 33 shows a side view of a robotic apparatus for the manipulation of tubing, tools and/or equipment on a drill floor or pipe deck of an oil and gas platform, performing another drill floor operation.

FIG. 33 shows the apparatus 501 configured to perform the drill floor operation of installing a lift sub into a bottom hole assembly (BHA) element disposed on a catwalk machine CW.

As shown, the apparatus 501 is arranged and operated substantially as described above with reference to FIG. 25. However, in this embodiment the end effectors 519*b* has been parked in the onboard tool rack 523.

In use, the apparatus 501 is configured to utilise the onboard power supply in the form of battery 507 to power the continuous track system and manoeuvre the apparatus 501 from the charging/docking station which forms the storage location (not shown) for the apparatus 501 to the work location around the well centre WC on the drill floor D, the apparatus 501 configured to use electrical power (in this embodiment from battery 507) and/or hydraulic power (from hydraulic lines 508) for the given work task itself.

Once located at the well centre WC, the locking pins 521 disposed in the undercarriage 502 are activated to extend into the drill floor D and are secured by the wedge lock arrangement 522.

The manipulator arms 509*a* and end effector 519*a* is then manipulated to insert a lifting sub L into the BHA element disposed on the catwalk machine CM.

Figure 34:
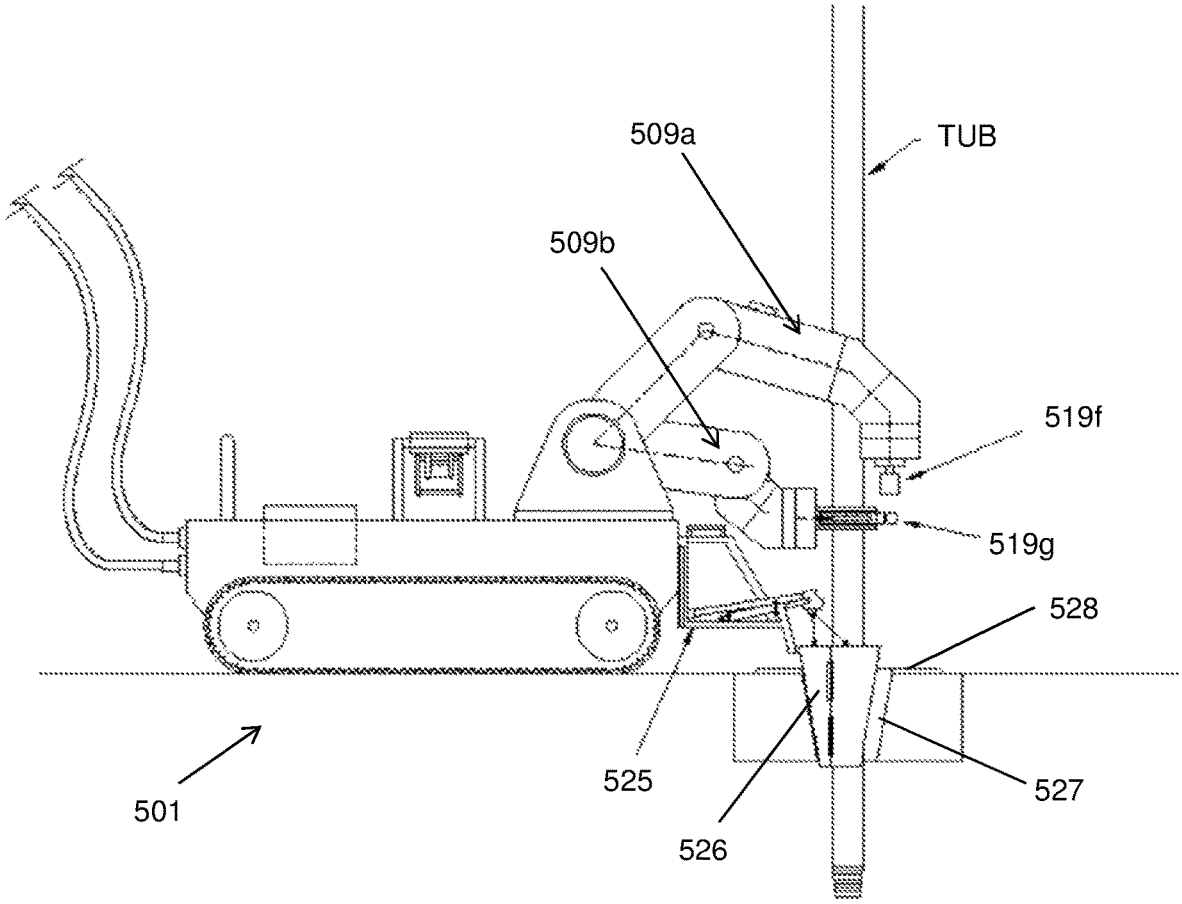
FIG. 34 shows a side view of a robotic apparatus for the manipulation of tubing, tools and/or equipment on a drill floor or pipe deck of an oil and gas platform, performing another drill floor operation.

FIG. 34 shows the apparatus 501 configured to perform the drill floor operation of setting manual slips and safety clamps.

As shown, the apparatus 501 is arranged and operated substantially as described above with reference to FIG. 25. However, in this embodiment the end effectors 519*a* has been replaced with a spinner/impact wrench 519*f* and the end effector 519*b* has been replaced with a safety clamp manipulator 519*g*.

The apparatus 501 has also been fitted with a slip lifter 525 at its front end. As the name suggests, the slip lifter 525 is configured to lift or insert a set of slips 526 into the rotary table bushings 527 around the tubular TUB. The tubular TUB is slowly lowered into the rotary table 528 and the set of slips 526 are further lowered until they wedge into the gap provided between the rotary bushings 527 and the tubular TUB. Once the set of slips 526 are set and the vertical movement of the tubular TUB has been arrested, the safety clamp is manipulated to close around the tubular TUB at a short distance above the set of slips 526. Once the safety clamp has been closed around the tubular TUB, the spinner/impact wrench 519*f* will engage to spin-in the locking nut on the safety clamp. The spinner/impact wrench 519*f* will further torque up the nut until a set torque value has been achieved. After this the spinner/impact wrench 519*f* will disengage and the lower manipulator 519*g* will release its grip on the safety clamp and both of the manipulator arms 509*a*, 509*b* will clear away from the tubular TUB, making ready to accurately stab in and spin in the next BHA element on top of the previous one sitting inside the slips 526 (i.e. this is done after sequentially repeating the steps of first removing the lifting sub on top of the BHA sitting in the slips 526, inserting a lifting sub horizontally into the next BHA element, removing the pin-end thread protector from the BHA before stabbing-and spinning it in to the one sitting in the slips 526. Once the new BHA element has been made up by an "iron roughneck" hydraulic tong HT (approaching from the opposing side of the apparatus 501) the top drive will pick-up weight on the new BHA. The apparatus 501 will now engage to grip and hold onto the safety clamp while the spinner/impact wrench 519*f* opens and releases the safety clamp. The slip lifter 525 will start pulling up on the set of slips 526 which will release and lift when the top drive slowly lifts the BHA a short vertical distance before lowering the BHA through the rotary table 528.

Hereafter, the process described above will repeat itself until the BHA has been fully assembled and set in the slips 526 and a drill pipe crossover is connected to the BHA. After this final step, the conventional set of slips 526 is no longer employed as from hereon in the BHA will be run from a drillstring through a hydraulic power slip in a standard automated drill pipe tripping sequence which will then not will require the apparatus 501 to be involved.

Figure 35:
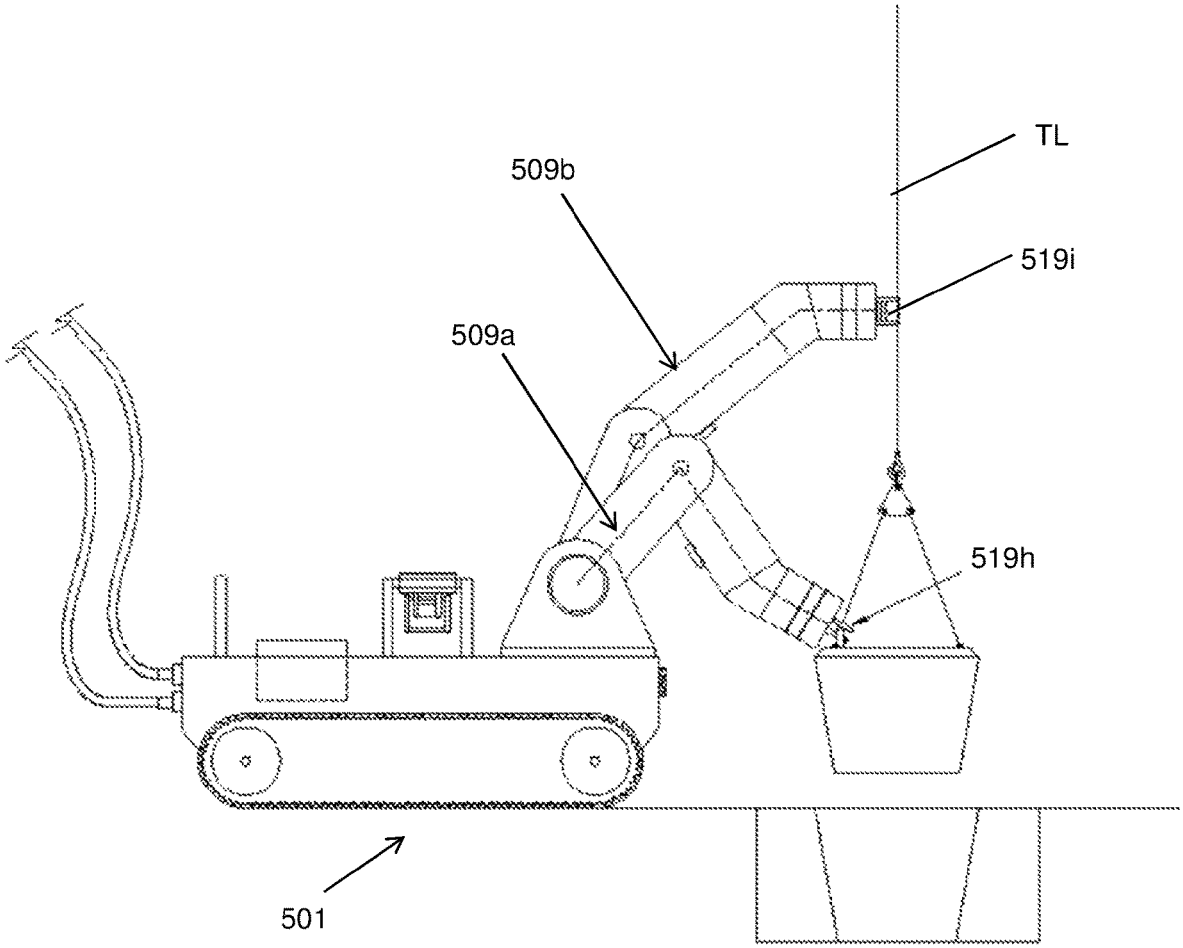
FIG. 35 shows a side view of a robotic apparatus for the manipulation of tubing, tools and/or equipment on a drill floor or pipe deck of an oil and gas platform, performing another drill floor operation.

FIG. 35 shows the apparatus 501 configured to guide a tugger line TL.

As described above, it is envisaged that the SWL-rating of the apparatus 501 will be such that as is necessary for the machine to be able to replace manual work processes normally performed by one or more personnel working around the work-centre—e.g. typically in the range of a few hundred kilos, but significantly less than a thousand kilos. For non-routine lifting of heavier items near or beyond the SWL-rating of the robot, the load of such items may be partly or entirely taken by a drill floor winch/tugger-line TL or by other means of hoisting or load carrying, while being guided into the work center WC position by the robot arm(s).

As shown, the apparatus 501 is arranged and operated substantially as described above with reference to FIG. 25. However, in this embodiment the end effectors 519*a*, 519*b* has been replaced with appropriate wire- and handle grabbers 519*h*, 519*i* for guidance of heavier items.

It will be recognised that the apparatus 501 may be configured to perform a number of operations. Beneficially, the provision of a modular apparatus permits a single apparatus to be adapted to perform a variety of drill floor operations, obviating the requirement for bespoke tools for each operation and reducing the space occupied on the drill floor.

By way of example of drill floor operations utilising the robotic apparatus 501 described above, reference is now made to FIGS. 36 and 37 of the accompanying drawings.

Figure 36:
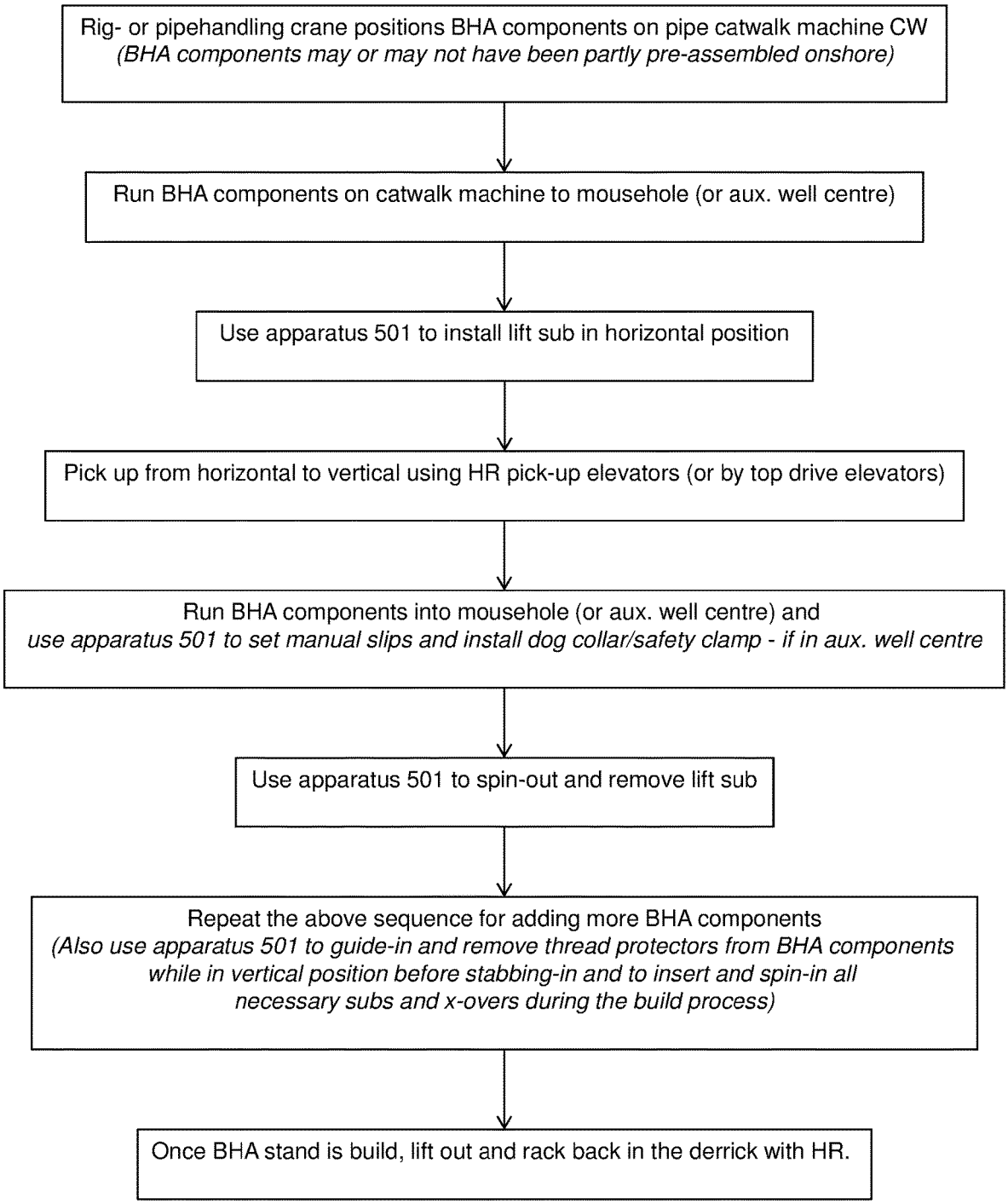
FIG. 36 is a flow chart of a method of performing a drill floor operation using the robotic apparatus.

FIG. 36 shows a method of building a Bottom Hole Assembly (BHA) in a Mouse Hole utilizing the robotic apparatus 501.

(A mousehole is an offline work centre in the drill floor wherein single joints/elements of tubulars are being assembled into longer stands (STD) of pipes, typically consisting of 3 or 4 joints, whereupon the stands are then transferred by a piperacker/Hydraracker (HR) to be held in the derrick vertical setback until needed).

Figure 37:
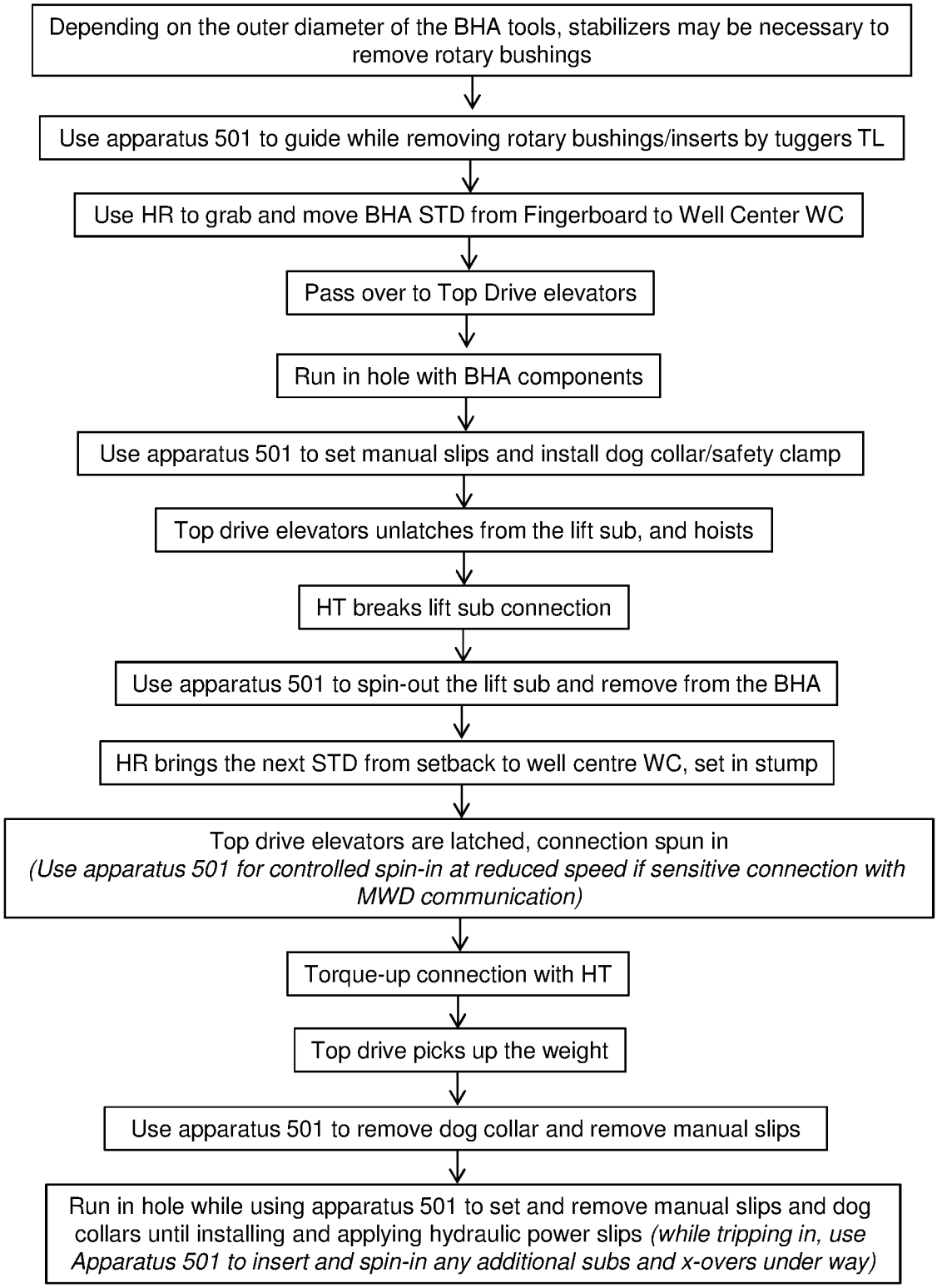
FIG. 37 is a flow chart of a method of performing another drill floor operation using the robotic apparatus.

FIG. 37 shows a method of handling and running the BHA on main well centre utilizing the robotic apparatus 501.

The invention claimed is:

1. A self-propelled robotic apparatus for performing offshore drill floor operations, comprising:

a support arrangement having an onboard electric power supply including a battery;

at least one manipulator arm configured for coupling to the support arrangement, the at least one manipulator arm is configured to carry an end effector configured to manipulate tubing, tools or equipment in order to perform a predetermined drill floor operation;

wherein the support arrangement is configured to move across an offshore drill floor, and the movement is powered by the onboard power supply; and wherein the support arrangement comprises an omni-directional drive unit disposed on an undercarriage and having one or more omni-directional rollers.

2. The robotic apparatus according to claim 1, wherein the onboard power supply provides power for moving on the drill floor.

3. The robotic apparatus according to claim 1, wherein the onboard power supply provides power for the apparatus to move between a storage position and a deployed position.

4. The robotic apparatus according to claim 3, wherein the apparatus may be configured to move between the storage position and the deployed position via one or more intermediate locations disposed on the drill floor.

5. The robotic apparatus according to claim 1, and comprising an onboard hydraulic power system receiving from external hydraulic lines hydraulic power required by the least one manipulator arm for performing a predetermined work task.

6. The robotic apparatus according to claim 1, wherein the battery is a rechargeable battery.

7. A robotic apparatus for performing drill floor operations, comprising:

a support arrangement having an onboard electric power supply including a battery;

at least one manipulator arm configured for coupling to the support arrangement, the at least one manipulator arm is configured to carry an end effector configured to manipulate tubing, tools or equipment in order to perform a predetermined drill floor operation;

wherein the support arrangement is configured to move across an offshore drill floor, and the movement is powered by the onboard power supply;

wherein the onboard power supply provides power for moving on the drill floor; and wherein the support arrangement includes a continuous track system, and is configured to utilize the onboard power supply to power the continuous track system and maneuver the apparatus from a docking station which forms a storage location for the apparatus to a work location around a well center on the drill floor.

8. The robotic apparatus according to claim 7, wherein the continuous track system comprises a multi-directional caterpillar drive.

9. The robotic apparatus according to claim 7, wherein the continuous track system comprises a track driven by a number of wheels, wherein the track comprises a plurality of interconnected chain links, and wherein the wheels are formed as sprocket wheels.

10. A robotic apparatus for performing drill floor operations, comprising:

a support arrangement having an onboard electric power supply including a battery;

at least one manipulator arm configured for coupling to the support arrangement, the at least one manipulator arm is configured to carry an end effector configured to manipulate tubing, tools or equipment in order to perform a predetermined drill floor operation;

wherein the support arrangement is configured to move across the offshore drill floor, the movement is powered by the onboard power supply;

wherein the support arrangement comprises a continuous track system and the apparatus is configured to move along a path determined by the type of operations to be carried out, and by equipment present on the drill floor.

11. A self-propelled robotic apparatus for performing offshore drill floor operations, comprising:

a support arrangement configured to move the apparatus across an offshore drill floor;

at least one manipulator arm configured for coupling to the support arrangement, the least one manipulator arm is configured to carry an end effector configured to manipulate tubing, tools or equipment in order to perform a predetermined drill floor operation;

a visual sensor arrangement formed as a camera system operatively associated with a machine vision system;

wherein the machine vision system being operatively associated with a machine learning system configured to control apparatus motions to perform given tasks; and wherein the apparatus through compliant motion control by the control system is configured to perform collaborative operations with other machinery on drill floor.

12. The robotic apparatus according to claim 11, comprising:

a control system configured for using compliant motion control;

wherein the control system is configured to apply supervised learning through which the apparatus is guided through a number of predefined sequences and thereby learn to perform Previously Presented tasks and operations.

13. The robotic apparatus according to claim 12, wherein the control system receives input from a sensor arrangement and is configured to perform inspection of tools.

14. The robotic apparatus according to claim 12, wherein the control system receives input from a sensor arrangement and is configured to perform identification operation, including reading of ID codes, or recognition of objects.

15. The robotic apparatus according to claim 14, wherein the control system is configured for personnel detection.

16. The robotic apparatus according to claim 11, wherein the visual sensor arrangement is operatively associated with a personnel detection and protection system for detecting the presence of human operators, wherein personnel detection and protection system is configured to issue a detection signal to be sent to a controller, wherein controller is adapted to issue a stop command or movement command to move away from the detected personnel.

17. The robotic apparatus according to claim 11, wherein the visual sensor arrangement includes proximity sensors, movement sensors, or thermals sensors for detecting personnel.

18. A self-propelled robotic apparatus for performing offshore drill floor operations, comprising:

a support arrangement configured to move the apparatus across an offshore drill floor;

at least one manipulator arm for coupling to the support arrangement, the least one manipulator arm is configured to carry an end effector configured to manipulate tubing, tools or equipment in order to perform a predetermined drill floor operation;

a visual sensor arrangement formed as a camera system operatively associated with a machine vision system;

a control system configured for using compliant motion control;

wherein the machine vision system being operatively associated with a machine learning system configured to control apparatus motions to perform given tasks;

wherein the control system is configured to apply supervised learning through which the apparatus is guided through a number of predefined sequences and thereby learn to perform tasks and operations; and wherein the control system receives input from the machine vision system and is configured to reliable sensing and object detection, and to control both the motion of the apparatus across the drill floor and motion of the at least one manipulator arm.

* * * * *